US006841750B2

(12) United States Patent
Sasaki

(10) Patent No.: US 6,841,750 B2
(45) Date of Patent: Jan. 11, 2005

(54) SWITCH DEVICE

(75) Inventor: Makoto Sasaki, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 241 days.

(21) Appl. No.: 10/376,613

(22) Filed: Feb. 27, 2003

(65) Prior Publication Data

US 2003/0159912 A1 Aug. 28, 2003

(30) Foreign Application Priority Data

Feb. 28, 2002 (JP) ..... 2002-053854

(51) Int. Cl.[7] ..... H01H 21/00

(52) U.S. Cl. ..... 200/553; 200/6 R; 200/558; 200/559; 200/339

(58) Field of Search ..... 200/6 R, 6 A, 200/6 B, 553, 557, 558, 559, 339

(56) References Cited

U.S. PATENT DOCUMENTS 3,299,224 A 1/1967 De Lome et al. ..... 200/68
4,427,850 A * 1/1984 Fassio ..... 200/6 R
5,285,039 A * 2/1994 Satoh ..... 200/563
5,967,303 A * 10/1999 Kurek et al. ..... 200/559
6,040,543 A * 3/2000 Mina et al. ..... 200/559
6,130,393 A * 10/2000 Chu ..... 200/556
6,140,713 A 10/2000 Stringwell ..... 307/10.1
6,242,706 B1 * 6/2001 Miyata ..... 200/537
6,420,669 B1 * 7/2002 Shenker et al. ..... 200/339

* cited by examiner

*Primary Examiner*—Michael A. Friedhofer
(74) *Attorney, Agent, or Firm*—Brinks Hofer Gilson & Lione

(57) ABSTRACT

A switch device that includes a case having a bottom wall and sidewalls; a fixed contact member; a movable contact member; a driving member mounted on the sidewalls; and restoring means for restoring the driving member to the original position. The driving member includes an actuating portion for moving the movable contact member and an operating portion for rotating the actuating portion, wherein the actuating portion moves the movable contact member and brings the movable contact member into contact with the fixed contact member when the operating portion is driven. The driving member is restored to the original state in which the movable contact member and the fixed contact member are brought out of contact by restoring means when the driven state of the operating portion is released.

20 Claims, 14 Drawing Sheets

SWITCH DEVICE

BACKGROUND OF THE INVENTION

1. Field of the Invention

The present invention relates to a switch device, and, more specifically, to a switch device suitable to be used for driving an on-vehicle power window apparatus.

2. Description of the Related Art

A switch device in the related art will be described referring to attached drawings. FIG. 18 is an exploded perspective view showing the switch device in the related art, and FIG.19 is a cross sectional view showing the switch device in the related art.

The switch device in the related art is a so-called bipolar/double-throw switch device having two switch element sets.

An enclosure 81 includes a substantially box-shaped case 82 and a plurality of fixed contact members 83 formed in the case 82 of metallic material by insert molding so as to extend partly outward from the case 82.

The case 82 includes a bottom wall 82*a,* sidewalls 82*b* surrounding four sides, a partitioning wall 82*c* disposed in parallel with one of opposing sidewalls 82*b,* and two openings 82*d* formed on top of the sidewalls 82*b* and the partitioning wall 82*c*.

The fixed contact member 83 includes a first, a second and a third fixed contact points (not shown). A first, a second and a third terminals 83*a,* 83*b* and 83*c* extend outward from the first, the second and the third fixed contact points (not shown) respectively.

The fixed contact member 83 is formed by insert molding on the bottom wall 82*a* of the case 82, so that the first, the second and the third fixed contact points (not shown) are partly exposed from the surface of the bottom wall 82*a,* and the first, the second and the third terminals 83*a,* 83*b* and 83*c* extend outward from one of the sidewalls 82*b*.

Two (two pairs of) fixed contact members 83 are disposed symmetrically with respect to the case 82.

A movable contact member 84 is formed symmetrically in a substantially M-shape, and includes a first movable contact point 84*a* located at the center of the movable contact member 84. A second and a third movable contact points 84*b* and 84*c* are provided at both free ends so as to interpose the first movable contact point 84*a* therebetween.

The movable contact member 84 is disposed such that the first movable contact point 84*a* is in contact with the upper surface of the first fixed contact point (not shown), the second movable contact point 84*b* is opposed to the second fixed contact point (not shown), and the third movable contact point 84*c* is opposed to the third fixed contact point (not shown).

In other words, the movable contact member 84 is stored in the case 82.

Two pieces of the movable contact members 84 are respectively disposed on the fixed contact members 83 as described above.

The movable contact member 84 is further disposed so as to be capable of a seesaw movement about the first movable contact point 84*a*.

A driving member 85 includes a substantially box-shaped base portion 85*a* and a pair of semi-cylindrical (semi-circular) driving portions 85*b* disposed at the lower end of the base portion 85*a*.

The driving member 85 is disposed in such a manner that the distal ends of the driving portions 85*b* are in contact with the first movable contact points 84*a* at the center of the M-shaped movable contact members 84 respectively.

A lid member 86 includes a rectangular upper wall 86*a,* sidewalls 86*b* surrounding four sides of the upper wall 86*a,* mounting portions 86*c* extending upward from the center between the opposing sidewalls 86*b,* through holes 86*d* formed coaxially on the pair of mounting portions 86*c* in the vicinity of the upper ends thereof, and a rectangular opening 86*e* formed between the pair of mounting portions 86*c*.

The lid member 86 engages the upper portion of the case 82 with suitable means such as snap engagement and the like so that the upper wall 86*a* thereof covers the two openings 82*d* of the case 82. In this case, the base portion 85*a* of the driving member 85 is disposed in the opening 86*e* of the lid member 86.

The spring member 87 is constructed of a coil spring, and the spring member 87 is disposed by suitable means in the base portion 85*a* of the driving member 85.

An operating tab member 88 includes a rectangular tab portion 88*a,* a rectangular storage section 88*b* extending downward from the center of the tab portion 88*a* and being surrounded along four sides, and a pair of cylindrical projections 88*c* projecting outward from one of the opposing outer surfaces of the storage section 88*b*.

An operating tab member 88 is disposed in such a manner that the storage section 88*b* is inserted into the opening 86*e* of the lid member 86, and the driving member 85 provided with a spring member 87 is disposed in the storage section 88*b*.

The pair of projections 88*c* of the operating tab member 88 are inserted into and attached to the respective through holes 86*d*.

In this state, the driving portion 85*b* of the driving member 85 drives the first movable contact point 84*a* of the movable contact member 84 toward the first fixed contact point (not shown) of the fixed contact member 83 by a resilient force of the spring member 87.

The operating tab member 88 is adapted to be capable of a swinging motion (clockwise or counterclockwise) about the pair of projections 88*c*. This swinging motion of the operating tab member 88 allows the driving member 85 to swing.

By such swinging motion of the driving member 85, the pair of driving portions 85*b* of the driving member 85 brings the movable contact member 84 formed into an M-shape into a seesaw motion. Such seesaw motion of the movable contact member 84 brings the second or the third movable contact point 84*b* or 84*c* of the movable contact member 84 into and out of contact with the second or the third fixed contact point (not shown) of the fixed contact member 83.

However, in the switch device in the related art, a relatively large lid member is disposed on the case, and the operating tab member is attached on the lid member for a swinging motion. Therefore, it has a disadvantage in that the entire construction of the switch device is upsized.

In addition, the switch device in the related art is not cost-effective owing to its higher manufacturing cost due to its relatively large number of components and the greater number of steps required in assembly.

Further more, since the spring member has to be built in the operating tab member in advance, it is not easy to assemble.

SUMMARY OF THE INVENTION

Accordingly, it is an object of the invention to provide a switch device wherein easy assembly, downsizing, and reduction in thickness are realized.

The switch device of the invention includes: a case having a bottom wall and at least an opposing pair of sidewalls extending from the bottom wall; a fixed contact member provided on the bottom wall of the case; a movable contact member disposed in the case; a driving member rotatably mounted on the pair of sidewalls; and restoring means for restoring the driving member to the original position. The driving member includes an actuating portion for moving the movable contact member and an operating portion for rotating the actuating portion, wherein the actuating portion is rotated when the operating portion of the driving member is driven and hence the actuating portion moves the movable contact member so that the movable contact member is brought into contact with a fixed contact member. The driving member is restored to the original position in which the movable contact member and the fixed contact member are brought out of contact by a restoring means when the driven state of the operating portion is released.

In the switch device in the related art, the spring member for resiliently pressing the movable contact member is disposed in the resiliently pressurized state between the operating tab member and the driving member, and thus the operating tab member is a required component, which requires six components. On the other hand, in the construction described above, the operating tab member is not disposed in the normal state of this switch device, and thus it may be constructed using four components including the driving member rotatably mounted on the sidewall and the restoring means for restoring the driving member to the original position. Since the number of components is small, the switch device can be easily assembled and reduced in size.

In the present switch device in this arrangement, since the operating tab for operating the switch device may be disposed separately from the switch device, the switch device may be standardized, and thus cost-cutting owing to volume efficiency is achieved.

The switch device according to the invention is characterized in that the restoring means is constructed of a spring member.

In this arrangement, such spring member contributes in providing a cost-effective switch device that can easily be formed.

The switch device according to the invention is characterized in that the driving member is driven by the spring member toward the bottom wall, and the driving member is restored to the original state by a driving force of the spring member.

In this arrangement, since the layout and the operations of the driving member and the spring member are simple, a switch device that is simple to fabricate and cost-effective can be provided.

The switch device according to the invention is characterized in that the spring member is formed of a plate having spring characteristics.

In this arrangement, since the spring member may be formed by pressing, a cost-effective and easy-to-build switch device can be provided.

The switch device according to the invention is characterized in that the case includes a sidewall surrounding four sides and an opening formed on top thereof, wherein the opening is covered by the spring member formed of a plate.

In this arrangement, since the case is hermetically closed by the sidewall and the spring member, foreign substances can be prevented from entering into a switching element. Thus, a switch device having a stable performance can be provided.

The switch device according to the invention is characterized in that the spring member is snap engaged with the sidewall of the case.

In this arrangement, a reliable switch device that is easy to assemble and reliable can be provided.

The switch device according to the invention is further characterized in that the driving member moves away from the bottom wall against a driving force of the spring member when the actuating portion of the driving member rotates, and simultaneously, the driving elements rotate so that the actuating portion moves the movable contact member to bring the movable contact member and the fixed contact member into contact with each other. The driving member is restored to the original state by the spring member to bring the movable contact member out of contact with the fixed contact member when the rotation of the driving member is released.

In this arrangement, since the action of the spring member is simple, a switch device having a driving member that can be operated smoothly and having a stable performance can be provided.

The switch device according to the invention is characterized in that the case is provided with a stopper for limiting the rotatable range of the operating portion of the driving member.

In this arrangement, since the rotatable range of the operating portion is limited by the stopper, the switch device has a stable rotatable range, thereby achieving reliable operation.

The switch device according to the invention is also characterized in that the operating portion of the driving member is positioned outside the case and the stopper is disposed outside the case, so that the operating portion abuts against the stopper to limit the rotational movement thereof.

In this arrangement, since the operating portion is positioned outside the case, the operation of the operating portion can be facilitated, making the operation and the construction of the switch device simple.

The switch device according to the invention is provided with a projection on one of the driving member and the opposing sidewalls of the case, as well as a recessed portion on the other one of them and a projection in the recess, so that the driving member is rotatably mounted on the case.

In this arrangement, the driving member may be attached easily on the case, and thus a cost-effective switch device that can be easily assembled is provided.

The switch device according to the invention is characterized in that the driving member is formed with a projection, wherein the case is formed with a recess, and the projection is disposed into the recess so that the driving member is rotatably mounted to the case.

In this arrangement, since it is easier to form the projection on the driving member and the recess on the case, a cost-effective switch device can be easily assembled.

The switch device according to the invention is also characterized in that the upper end of the sidewall is provided with a recess opened on top, and a projection is fitted into the recess from above.

In this arrangement, since the projection may be fitted from above, the invention provides a cost-effective switch device that can be more easily assembled.

The switch device according to the invention is also characterized in that the recess on the sidewall is formed to have almost the same width as the diameter of the projection on the driving member, and the projection is adapted to be movable in a vertical direction in the recess.

In this arrangement, since the projection of the driving member is movable in a vertical direction in the recess, the projection is not subject to excessive force, and thus a switch device with stable performance can be maintained for a long time.

The switch device according to the invention is characterized in that the movable contact member includes a flat portion, a rising portion extending from one of the ends of the flap portion in a tilted state, and a contact portion extending from one of the ends of the rising portion and coming into and out of contact with the fixed contact member, and the movable contact member is supported so as to be capable of a seesaw movement.

In this arrangement, since the movable contact member is adapted to be capable of a seesaw movement, and is formed asymmetrically, the direction of the movable contact member may be identified when disposing it on the fixed contact member, and thus reliable assembly of a switch device is ensured.

The switch device according to the invention is characterized in that the movable contact member performs a seesaw movement through the pressure exerted by the actuating portion displaced from the flat portion to the rising portion so that the movable contact member is brought into contact with the fixed contact member and performs a seesaw movement to be restored to the original state by the pressure due to the actuating portion being displaced from the rising portion to the flat portion so that the movable contact member is brought out of contact with the fixed contact member.

In this arrangement, since the seesaw movement of the movable contact member may be performed by a simple action of the actuating portion of the driving member, a switch device having a reliable action is provided.

The switch device according to the invention is also characterized in that the fixed contact member is constantly in contact with the movable contact member, and includes a first fixed contact point for supporting the movable contact member and a second fixed contact point for coming into and out of contact with the movable contact member, wherein the movable contact member is adapted to perform a seesaw movement about the first fixed contact point.

In this arrangement, since the fulcrum of the seesaw movement of the movable contact member is set to the first fixed contact point, a simple construction in which the first fixed contact point and the movable contact member are constantly in contact with each other is achieved, thus providing a cost-effective switch device.

The switch device according to the invention is characterized in that the fixed contact member includes a third fixed contact point, wherein the movable contact member is brought into contact with the first fixed contact point and the third fixed contact point. Thus the portion between the first and the third fixed contact points is in the ON state when the driving member is not in operation, while the flat portion of the movable contact member is brought out of contact with the third fixed contact point and thus the portion between the first and the third fixed contact points is in the OFF state. Simultaneously, the movable contact member is bought into contact with the second fixed contact point so that the portion between the first and the second fixed contact points is in the ON state when the driving member is actuated. This arrangement provides a cost-effective monopolar/double-throw switch device with a small number of components.

The switch device according to the invention is also characterized in that a switch element set is constructed of the fixed contact member, the movable contact member, the driving member, and the restoring means, and two switching element sets are disposed in parallel in the case.

In this arrangement, the cost-efficient bipolar/double-throw switch device includes a small number of components and is thus easy to assemble.

The switch device according to the invention is characterized in that the two movable contact members constituting a part of the two switching element sets are disposed alternately with respect to the case so that the flat portions of the respective movable contact members are oriented in the opposite directions.

In this arrangement, since the asymmetric two movable contact members are disposed alternately with respect to the case, the longitudinal dimension of the case may be shortened, and thus the downsizable switch device is provided.

The switching device according to the invention further includes a spring member formed of a plate, and is characterized in that the spring member includes a slit and a first and a second spring portions located at both sides of the slit, the first and the second spring portions are disposed so as to cover the upper portion of the case, and one of the driving member constituting a part of the two switching element sets is pressurized by the first spring portion and the other driving member is pressurized by the second spring portion.

In this arrangement, the first and the second spring portions may operate one or the other one of the driving members separately, the operating method may be diversified and thus a multifunction switch device is provided.

DESCRIPTION OF THE PREFERRED EMBODIMENTS

Figure 1:
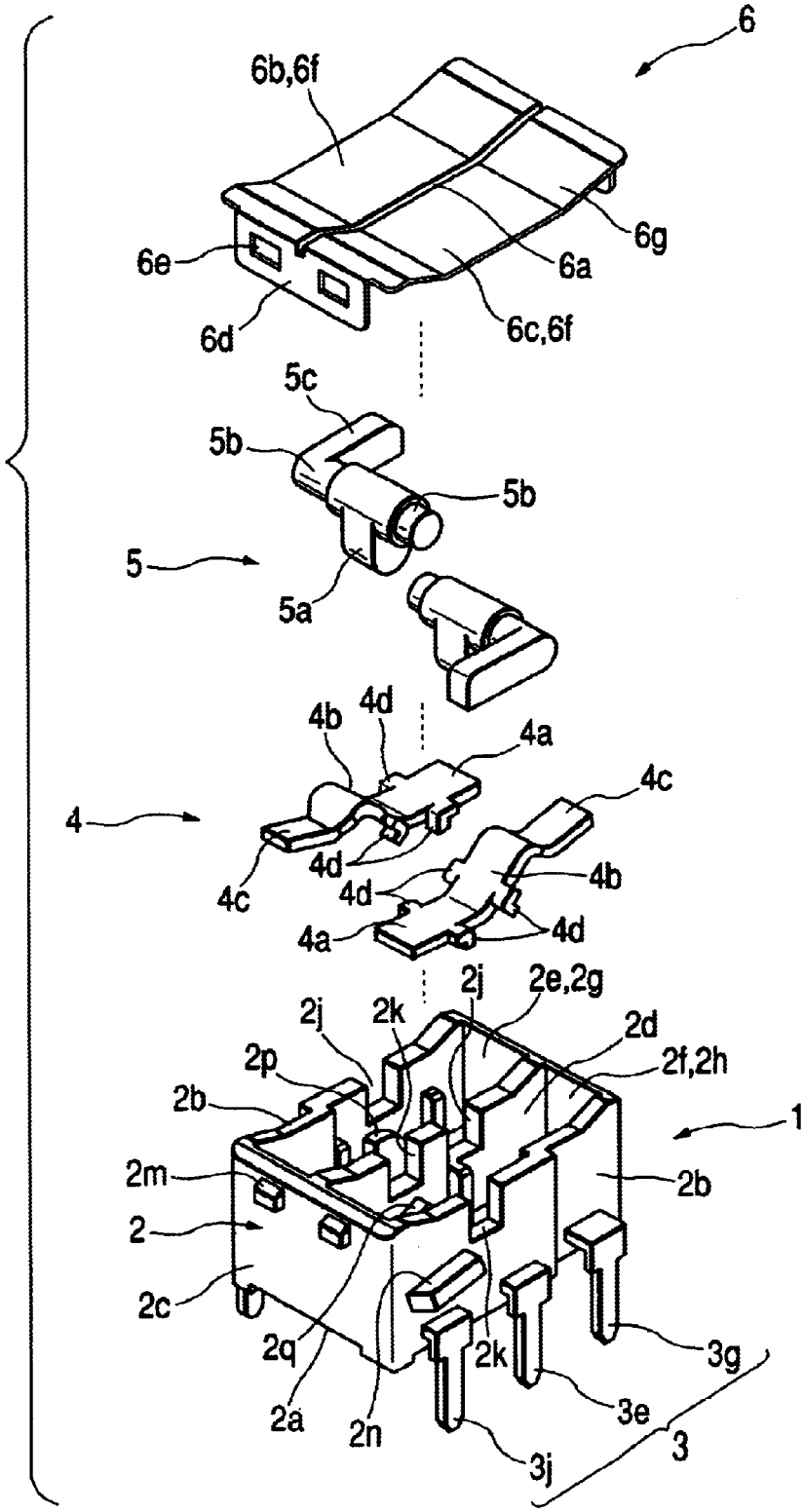
FIG. 1 is an exploded perspective view showing a first embodiment of the switch device according to the invention.
Figure 2:
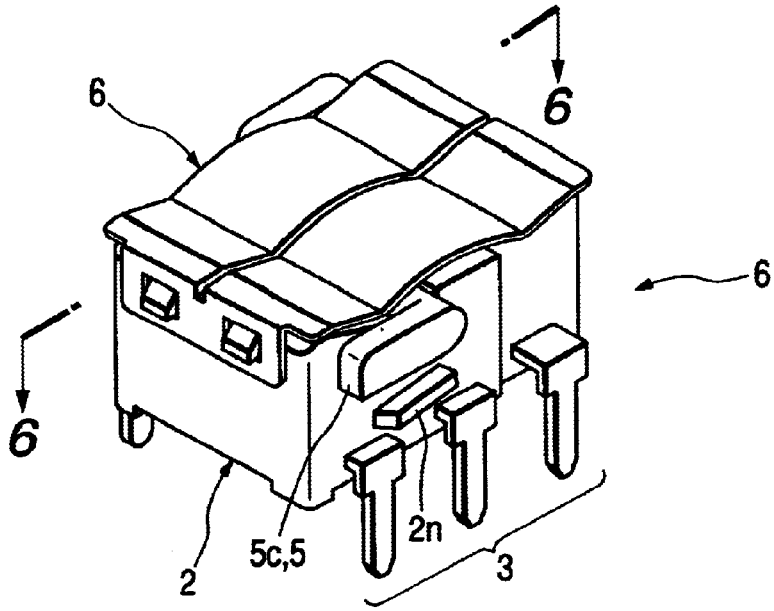
FIG. 2 is a perspective view showing the first embodiment of the switch device according to the invention.
Figure 3:
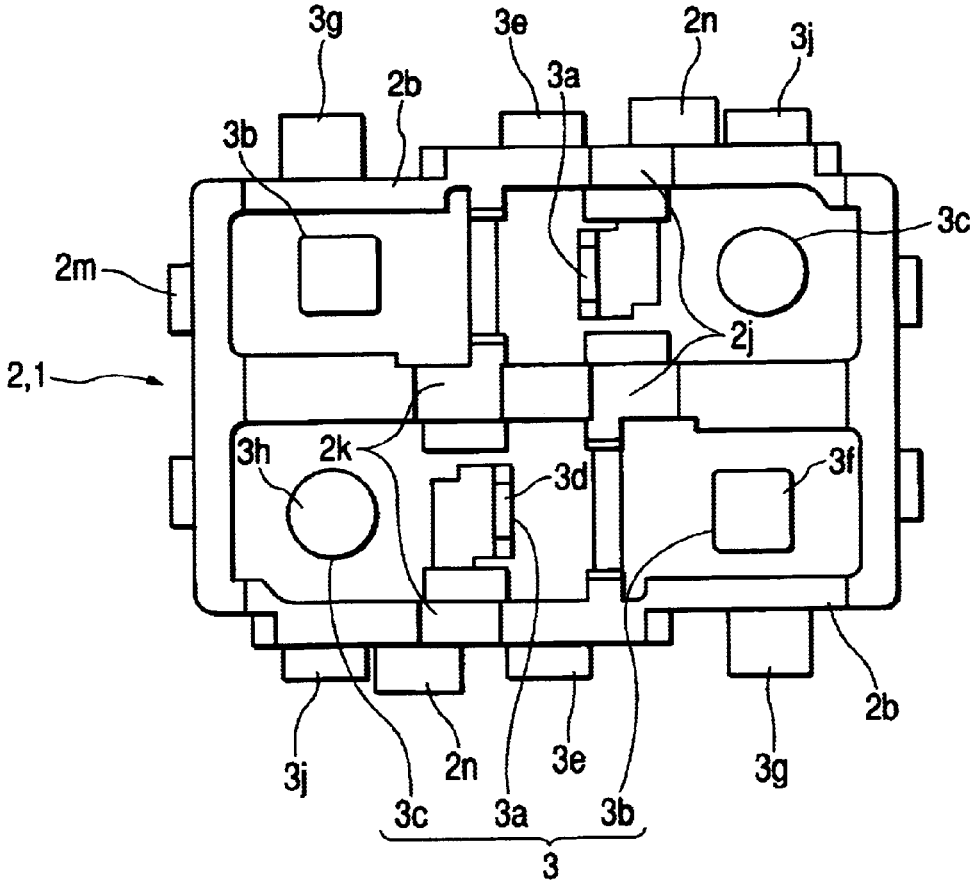
FIG. 3 is a plan showing an embodiment of a case and a fixed contact member relating to the switch device according to the invention.
Figure 4:
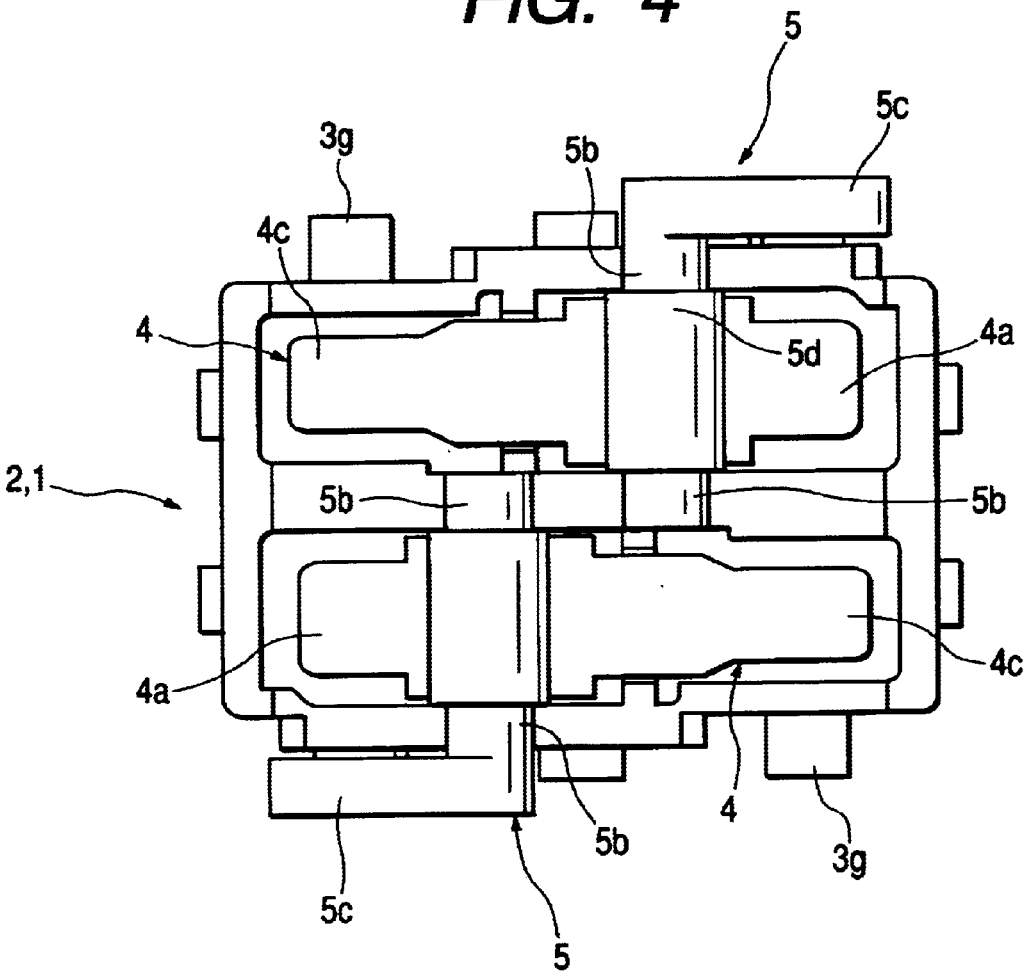
FIG. 4 is a plan view of the switch device according to the invention, showing a state in which a spring member is removed from the switch device.
Figure 5:
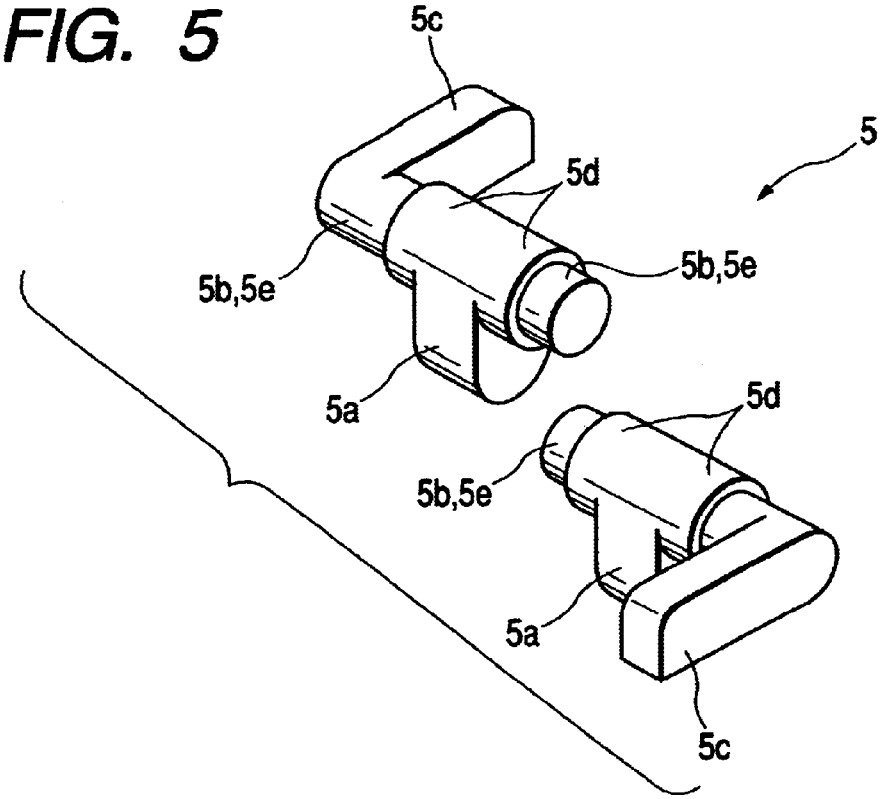
FIG. 5 is a perspective view showing an embodiment of the driving member relating to the switch device according to the invention.
Figure 6:
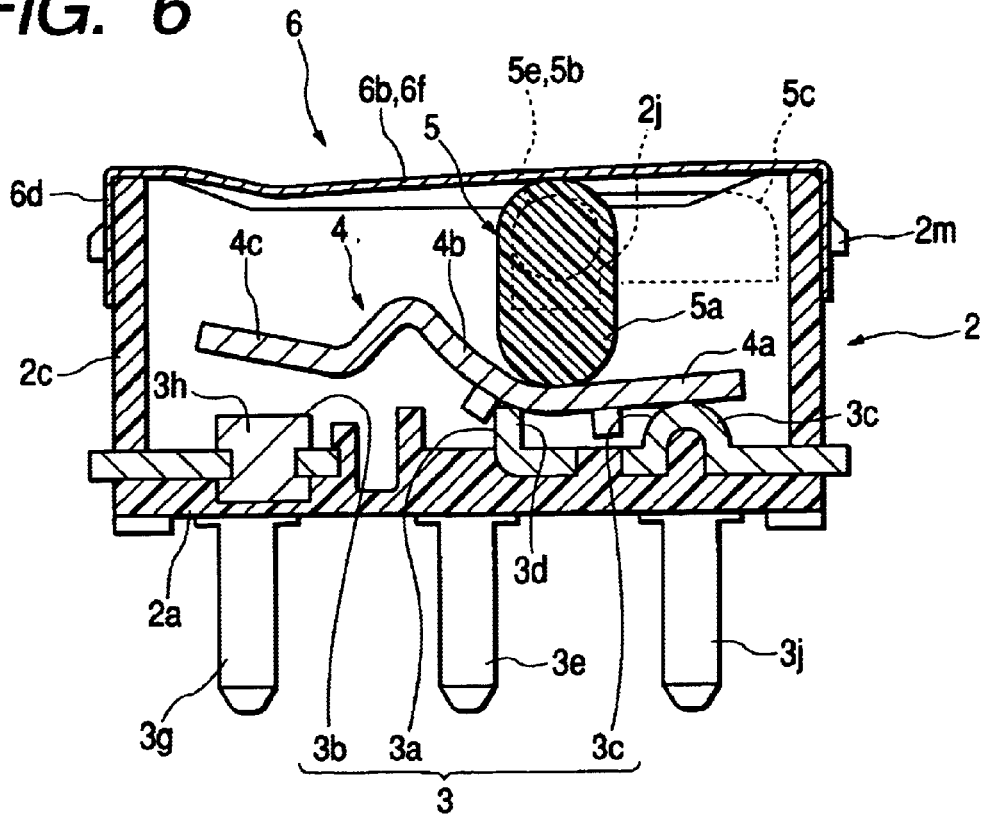
FIG. 6 is a cross sectional view taken along line 6—6 in FIG. 2.

Referring now to the drawings, embodiments of the invention will be described.

Referring to FIG. 1 to FIG. 6, an enclosure 1 is formed of insulative synthetic resin material and includes a substantially box shaped case 2 formed by molding, and a plurality of sets of fixed contact members 3 formed in the case 2 by insert molding of metallic material so as to extend partly outward from the case 2.

The case 2 includes a rectangular bottom wall 2*a,* first sidewalls 2*b,* which are one of the opposing sidewalls, extending forward from the bottom wall 2*a,* second sidewalls 2*c* which are the other one of the opposing sidewalls, third sidewalls 2*d* disposed at a substantially midpoint between the opposing first sidewalls 2*b,* a first opening 2*e,* a second opening 2*f* disposed in parallel with the first opening 2*e.* A sidewall surrounding four sides is constructed of the first sidewall 2*b* and the second sidewall 2*c* and two first and second storage sections 2*g* and 2*h* are formed by the third sidewall 2*d 2* in the case 2.

The pair of the first sidewalls 2*b* and the third sidewall 2*d* are formed with pairs of recesses 2*j* and 2*k* opened on top of the first and the third sidewalls 2*b* and 2*d.*

The axial lines of the one pair of recesses 2*j* and the other pair of recesses 2*k* extend in the direction orthogonal to the inner and outer side surfaces of the first and the third sidewalls 2*b* and 2*d* and in parallel with each other.

In other words, one pair of the recesses 2*j* are disposed coaxially with each other on one of the first sidewalls 2*b* and the third sidewall 2*d,* and the other pair of recesses 2*k* are disposed coaxially with each other on the other one of the pair of first sidewalls 2*b* and the third sidewall 2*d.*

Therefore, the third sidewall 2*d* is formed with one of the recesses 2*j* and one of the recesses 2*k* side by side in parallel with each other.

On the opposing pair of first sidewalls 2*b* on the outer surfaces, there are formed a pair of stopper 2*n* in the vicinity of the respective recesses 2*j* and 2*k.*

On the opposing pair of second sidewalls 2*c* on the outer surface, there are formed two projections 2*m* respectively.

Under the respective aforementioned pairs of recesses 2*j* and 2*k,* there are formed a pair of supporting members 2*p* and 2*q* having arcuate upper surfaces respectively.

The fixed contact member 3 is formed by pressing of conductive metal, and includes a first fixed contact point 3*a* provided at the central portion, a second fixed contact point 3*b* disposed in the vicinity of the first fixed contact point 3*a,* and a third fixed contact point 3*c* disposed in the vicinity of the first fixed contact point 3*a* at the position interposing the first fixed contact point 3*a* with respect to the second fixed contact point 3*b.*

Defining a set of the first, the second, and the third fixed contact points 3*a,* 3*b* and 3*c* as a fixed contact member 3, two sets of the fixed contact member 3 are disposed alternately with respect to the case 2.

The first fixed contact point 3*a* includes a first contact portion 3*d* and the first terminal 3*e* extending from the first contact portion 3*d.*

The second fixed contact point 3*b* includes a second contact portion 3*f* and the second terminal 3*g* extending from the second contact portion 3*f.*

The third fixed contact point 3*c* includes a third contact portion 3*h* and the third terminal 3*j* extending from the third contact portion 3*h.*

The first contact portion 3*d,* the second contact portion 3*f,* and the third contact portion 3*h* are disposed in such a manner that a part of the respective surfaces are exposed from the bottom wall 2*a* of the case 2. The first terminal 3*e,* the second terminal 3*g* and the third terminal 3*j* extend respectively outward at the position at almost the same distances from the opposing first sidewalls 2*b* of the case 2.

A movable contact 4 is formed by pressing of a plate material of conductive metal, and includes a flat portion 4*a* formed on one side and a rising portion 4*b* extending from one of the ends of the flat portion 4*a* in a tilted state, and a contact portion 4*c* extending from one of the ends of the rising portion 4*b.*

In other words, the movable contact member 4 is formed asymmetrically.

At the boundary between the flat portion 4*a* and the rising portion 4*b,* two pairs of locking projections 4*d* are formed.

The movable contact members 4 are stored and disposed respectively in the two first and the second storage sections 2*g* and 2*h* of the case 2 by clamping the pair of supporting members 2*p* and 2*q* of the case 2 by the two pairs of locking projections 4*d,* and are adapted so as to be capable of performing a seesaw movement about the respective first fixed contact points 3*a* in the first and the second storage sections 2*g* and 2*h* respectively. In this case, the respective movable contact members 4 are respectively disposed in the first and the second storage sections 2*g* and 2*h* alternately with respect to the case 2 in such a manner that the flat portions 4*a* are oriented in the opposite directions.

A driving member 5 is formed by molding of an insulative synthetic resin material, and includes an actuating portion 5*a* formed into a predetermined thickness and being oval in cross section, a pair of projections 5*b* constituting a cylindrical shaft located at the front end of the actuating portion 5*a* so as to extend respectively in the direction orthogonal to the opposing surfaces of the actuating portion 5*a,* and a rectangular column shaped lever portion 5*c* extending from the distal end portions of one of the projections 5*b* in parallel with the opposing surfaces of the actuating portion 5*a* in the direction orthogonal to the extending rear end of the actuating portion 5*a* and the axial center of the projection 5*b.*

The pair of aforementioned projections 5*b* and the lever portion 5*c* constitute an operating portion for rotating the actuating portion 5*a.*

The actuating portion 5*a,* the projection 5*b,* and the lever portion 5*c* are extending respectively in the three directions of substantially x-y-z axes.

The projection 5*b* includes a larger diameter portion 5*d* provided on the actuating portion 5*a* side and a smaller diameter portion 5*e* provided on the side further from the actuating portion 5*a*.

The lever portion 5*c* extends from the distal end of the smaller diameter portion 5*e* on one side so as to be orthogonal thereto.

The smaller diameter portions 5*e* of the pair of projections 5*b* of the driving member 5 are disposed in the pair of recesses 2*j* formed on the upper end of the first and the third sidewalls 2*b* and 2*d* of the case 2 respectively and opened on top, and the actuating portion 5*a* of the driving member 5 is rotatably attached to the case 2.

In other words, the pair of recesses 2*j* is adapted so that the pair of projections 5*b* may be fitted from above the case 2. In this case, the width dimensions of the pair of recesses 2*j* of the first and the third sidewalls 2*b* and 2*d* are almost the same as the diameters of the pair of the projections 5*b* of the driving member 5, and the pair of projections 5*b* are disposed so as to be capable of moving in the vertical direction in the pair of recesses 2*j*.

At this moment, the lever portion 5*c* of the driving member 5 is positioned outside the case 2 so as to face toward the outer wall surface of one of the first sidewalls 2*b*, and the lever portion 5*c* is disposed in the vicinity of the stopper 2*n*.

As described above, although the construction of one of the pairs of recesses 2*j* and one of the pairs of projections 5*b* are described, the construction of the other pair of the recesses 2*k* and the pair of the projections 5*b* will not be described since the construction is the same except that the respective lever portions 5*c* are alternately disposed with respect to the case 2 so as to be oriented in the opposite directions.

The spring member 6 as restoring means is formed by pressing of a metallic plate-shaped material having resiliency such as stainless material (SUS), and includes a linear slit 6*a*, a first and a second spring portions 6*b* and 6*c* disposed in parallel on both sides of the slit 6*a*, a pair of sidewalls 6*d* extending substantially perpendicularly downward from one of the opposing ends of the first and the second spring portions 6*b* and 6*c*, and two through holes 6*e* provided on both sidewalls 6*d*.

The first and the second spring portions 6*b* and 6*c* includes a plate-shaped holding portion 6*f* at the respective centers thereof, and tilted portions 6*g* tilting from the opposing both ends of the holding portions 6*f*. The slit 6*a* is formed between the pair of holding portions 6*f* and the pair of tilted portions 6*g*.

A switch element set is constructed of the fixed contact member 3, the movable contact member 4, the driving member 5, and the spring member 6 as restoring means (the first or the second spring portion 6*b* or 6*c*). The switch element is disposed partly in the first and the second storage sections 2*g* and 2*h* respectively, and two switch element sets are disposed in the case 2 alternately with respect to the case 2.

The spring member 6 is disposed in such a manner that the first and the second spring portions 6*b* and 6*c* mounted in parallel cover the first and the second openings 2*e* and 2*f* formed on top of the case 2 respectively.

The first and the second spring portions 6*b* and 6*c* are disposed in such a manner that one of the driving members 5 constituting a part of the two switch element sets is pressed by the first spring portion 6*b* and the other driving member 5 is pressed by the second spring member 6*c*.

At this moment, the respective through holes 6*e* of the pair of sidewalls 6*d* of the spring member 6 engage the respective projections 2*m* on the case 2 in a snap-in manner, so that the spring member 6 is reliably attached to the case 2.

In addition, at this moment, free ends of the actuating portions 5*a* of one and the other driving members 5 pressurize the connecting portion (the flat portion 4*a* side) between the flat portion 4*a* and the rising portion 4*b* of the movable contact member 4, which allows the movable contact member 4 to be brought into contact with the first fixed contact point 3*a* and the third fixed contact point 3*c*, so that the portion between the first and the third fixed contact points 3*a* and 3*c* is in the ON state and the first fixed contact point 3*a* and the second fixed contact point 3*b* is brought out of contact with respect to each other so that the portion between the first and the second fixed contact points 3*a* and 3*b* are in the OFF state.

Figure 7:
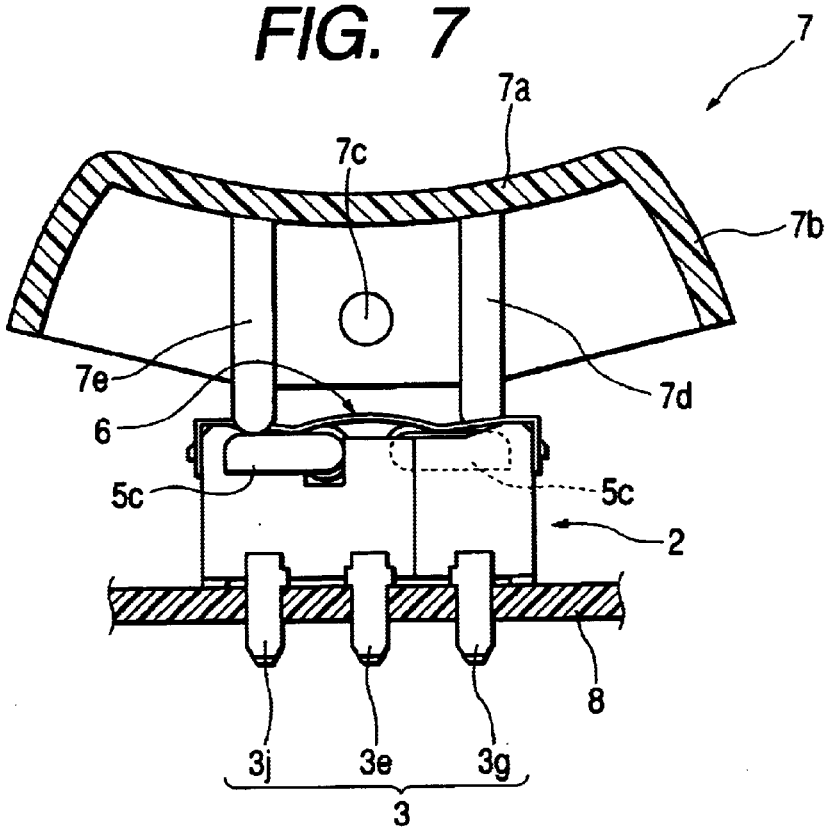
FIG. 7 shows the switch device according to the invention, and is a partly cross sectional front view illustrating the switch device and a tab member for operating the switch device.
Figure 8:
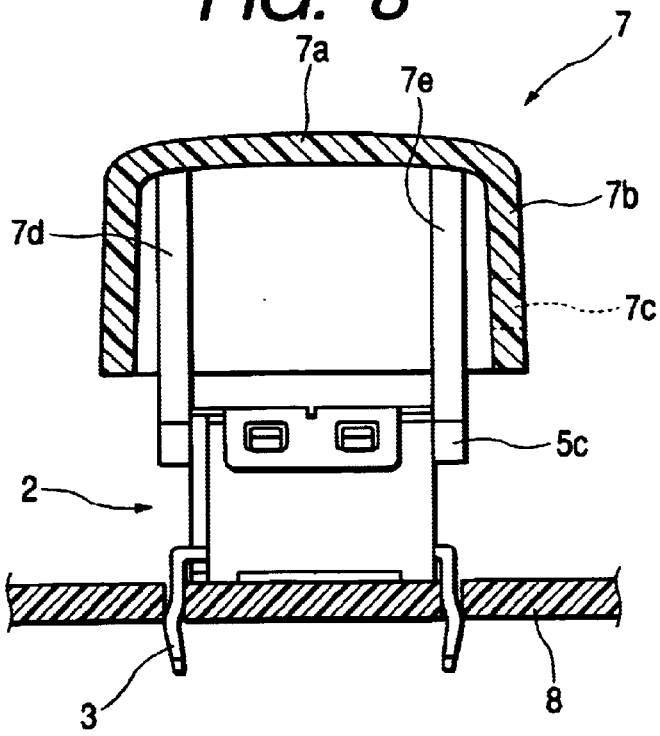
FIG. 8 shows the switch device according to the invention, and is a partly cross sectional side view illustrating the switch device and the tab member for operating the switch device.

In this state, the switch device is, as shown in FIG. 7 and FIG. 8, is provided with a tab member 7 for operating the switch device disposed above the switch device, for example, on the operating enclosure (not shown) so as to be capable of a swinging motion with respect to the switch device.

Referring to FIG. 7 and FIG. 8, the tab member 7 will now be described.

As shown in FIG. 7 and FIG. 8, the tab member 7 includes an upper wall portion 7*a* formed by a curved surface, a sidewall portion 7*b* surrounding four sides of the upper wall portion 7*a* and having a gentle inclination, a pair of through holes 7*c* provided at the substantially center of one of the opposing sidewall portions 7*b*, two operating portions 7*d* and 7*e* extending downward from a predetermined alternate portion of the inner surface of the upper wall portion 7*a*.

The distal ends of these two operation portions 7*d* and 7*e* are projecting outward from the lower end of the sidewall portion 7*b*.

The tab member 7 is attached to, for example, the operating enclosure, not shown, so as to be capable of a swinging motion by a pair of projections (not shown) formed on the operating enclosure inserted into a pair of through holes 7*c*.

The switch device is attached to a printed wiring substrate 8 by suitable means such as soldering or the like, and the two operating portions 7*d* and 7*e* of the tab member 7 are disposed in a state of being in contact with the respective lever portions 5*c* of the driving members 5 of the switch device.

In other words, the tab member 7 is constructed separately from the switch device and disposed above the switch device by suitable means.

The method of assembly of the switch device according to the invention will be described below.

In the first place, the enclosure 1 having the case 2 and the fixed contact member 3 is placed on a predetermined assembling and transporting jig (not shown) with the upper surface of the first and the second openings 2*e* and 2*f* faced upward.

Then, the pair (two) of movable contact members 4 are inserted and disposed on the respective fixed contact members 3 from the first and the second openings 2*e* and 2*f* of the case 2 so as to be oriented alternately.

By arranging the respective movable contact members 4 in the case 2, the movable contact members 4 are disposed respectively in the first and the second storage sections 2*g* and 2*h* by suitable means, and the substantially centers of the respective movable contact members 4 are placed on the first fixed contact point 3*a* of the fixed contact member 3 so as to be capable of a seesaw movement.

Subsequently, the actuation portion 5*a* of the driving member 5 is placed with the free end oriented downward, and the pair of projections 5*b* are fitted into one and the other pairs of recesses 2*j* and 2*k* of the case 2 respectively. In this state, the respective lever portions 5*c* are disposed outside the respective opposing first sidewalls 2*b*.

In this state, the free end of the actuating portion 5*a* is disposed in the vicinity of the connecting portion between the flat portion 4*a* and the rising portion 4*b* of the movable contact member 4 in an abutted state.

Subsequently, the first and the second spring portions 6*b* and 6*c* of the spring member 6 are disposed so as to cover the first and the second openings 2*e* and 2*f* formed on top of the case 2, and the respective through holes 6*e* on the spring member 6 are engaged with the projections 2*h* on the case 2 in a snap-in manner, so that the spring member 6 is mounted on the case 2 (enclosure 1).

In this state, the first and the second spring portions 6*b* and 6*c* are attached in a state of slightly pressing the tops (upper portions) of the actuating portions 5*a* of the respective driving members 5 resiliently toward the bottom wall 2*a,* and thus in a state in which the free ends (lower portions) of the actuating portions 5*a* forces the movable contact member 4 to be abutted against the fixed contact member 3 by such resilient pressure.

As described above, the switch device is constructed to be assembled by storing and placing in sequence the movable contact member 4, the driving member 5, and the spring member 6 as restoring means from above into the case 2 (enclosure 1) with the fixed contact member 3 disposed therein.

Figure 9:
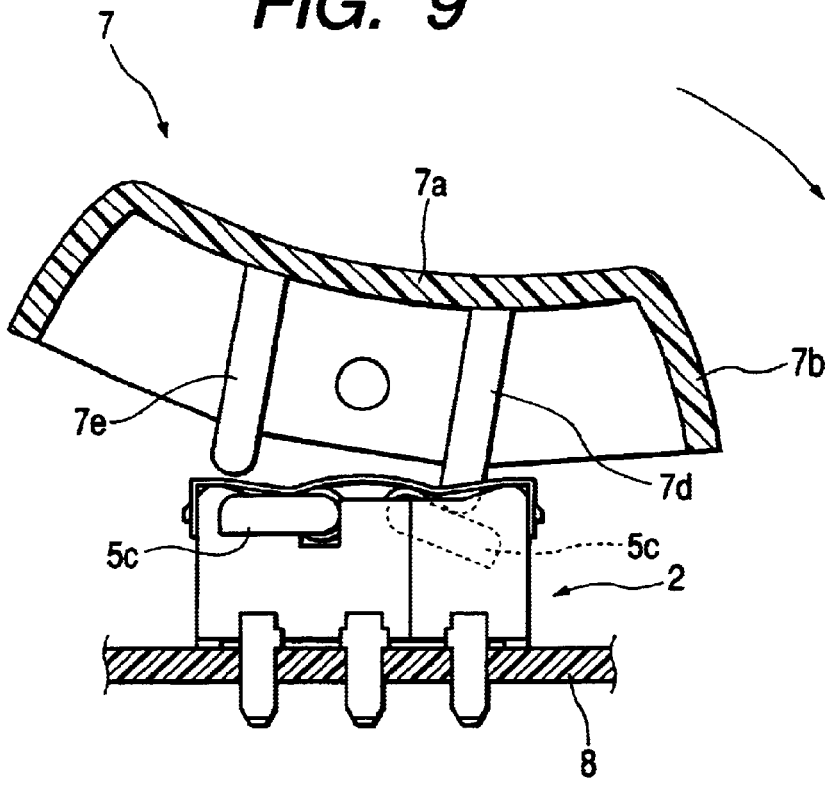
FIG. 9 is a first drawing illustrating the action of the switch device according to the invention.
Figure 10:
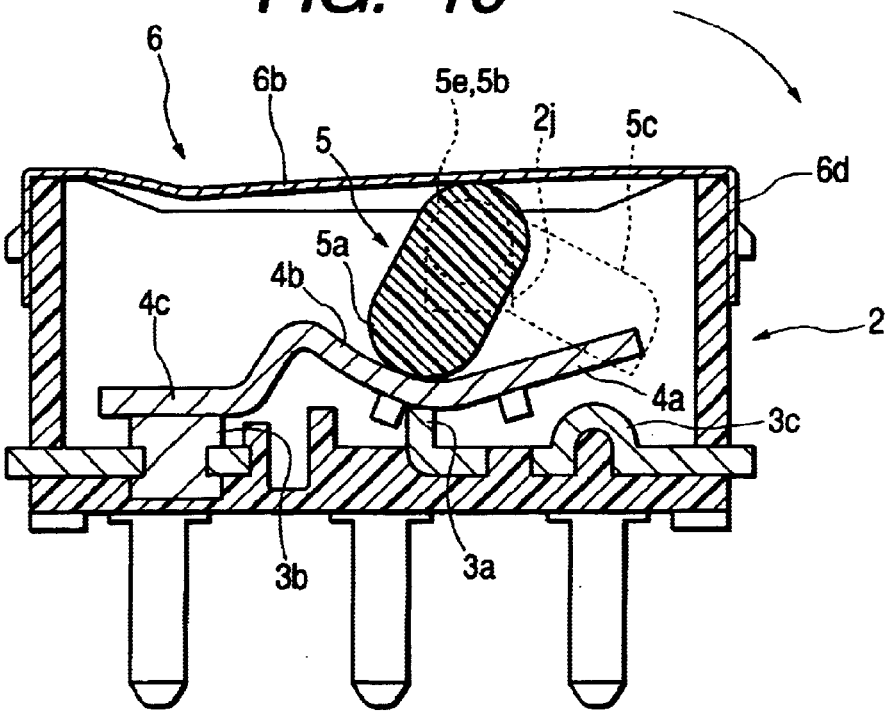
FIG. 10 is a cross sectional view for explaining the action of the switch device according to the invention.

Subsequently, referring to FIG. 9 to FIG. 11, the operation of the switch device according to the invention will be described.

When the tab member 7 is not inclined to any directions and the respective driving members 5 are in the neutral positions as shown in FIG. 7, two switch element sets are such that the respective movable contact members 4 are brought into contact with the first fixed contact points 3*a* and the third fixed contact points 3*c* respectively, and the portions between the first and the third fixed contact points 3*a* and 3*c* are in the ON state, while the portions between the first fixed contact points 3*a* and the second fixed contact points 3*b* are moved away from each other and thus the portions between the first and the second fixed contact points 3*a* and 3*b* are in the OFF(non-contact) state, which is the first switched state.

In other words, the two switch element sets disposed alternately (with back side faced to each other) in the case 2 is also in the first switched state.

Subsequently, when the one of the ends (right side in FIG. 7) of the upper wall portion 7*a* of the tab member 7 is pressed from the state shown in FIG. 7 to rotate the tab member 7 about the through hole 7*c* clockwise, one of the operating portions 7*e* of the tab member 7 is moved away from the lever portion 5*c* of one of the driving members 5 (the lever portion 5*c* on the front side in FIG. 9), whereby the switch element on the front surface side in FIG. 9 maintains the first switched state.

On the other hand, by rotation of the other operation portion of the tab member 7, the lever portion 5*c* (lever portion 5*c* on the rear surface side in FIG. 9) of the other driving member 5 is rotated. By the rotation of the lever member 5*c,* the actuating portion 5*a* of the other driving member 5 slides (is displaced) on the rising portion 4*b* (See FIG. 10) from the flat portion 4*a* of the other movable contact member 4, and the other movable contact member 4 is rotated about the first fixed contact point 3*a*. As a consequence, the second switched state in which the contact portion 4*c* of the other movable contact member 4 and the second fixed contact point 3*b* are brought into contact with each other to the ON state, and the first fixed contact point 3*a* and the second fixed contact point 3*b* are moved away from each other to the OFF state (non-contact).

In this state, the pair of projections 5*b* of the other driving members 5 are adapted to move slightly upward against a resilient force of the spring member 6 in the pair of recesses 2*k* on the case 2.

In this state, when the switch device is a power-window switch, for example, the motor is switched to the direction to open the window glass.

When the rotational movement of the tab member 7 effected by pressing the tab member 7 is released, the pressure from the actuating portion 5*a* of the driving member 5 is displaced from the rising portion 4*b* to the flat portion 4*a* by a self-restoring force of the spring member 6, and thus the actuating portion 5*a* is restored to the original position, whereby the other movable contact member 4 moves to restore the first switched state. In this manner, the movable contact member 4 is adapted to perform a seesaw movement.

The pair of projections 5*b* of the other driving member 5 are constructed to move slightly downward by a resilient force of the spring member 6 in the pair of recesses 2*j* of the case 2 in this state.

Figure 11:
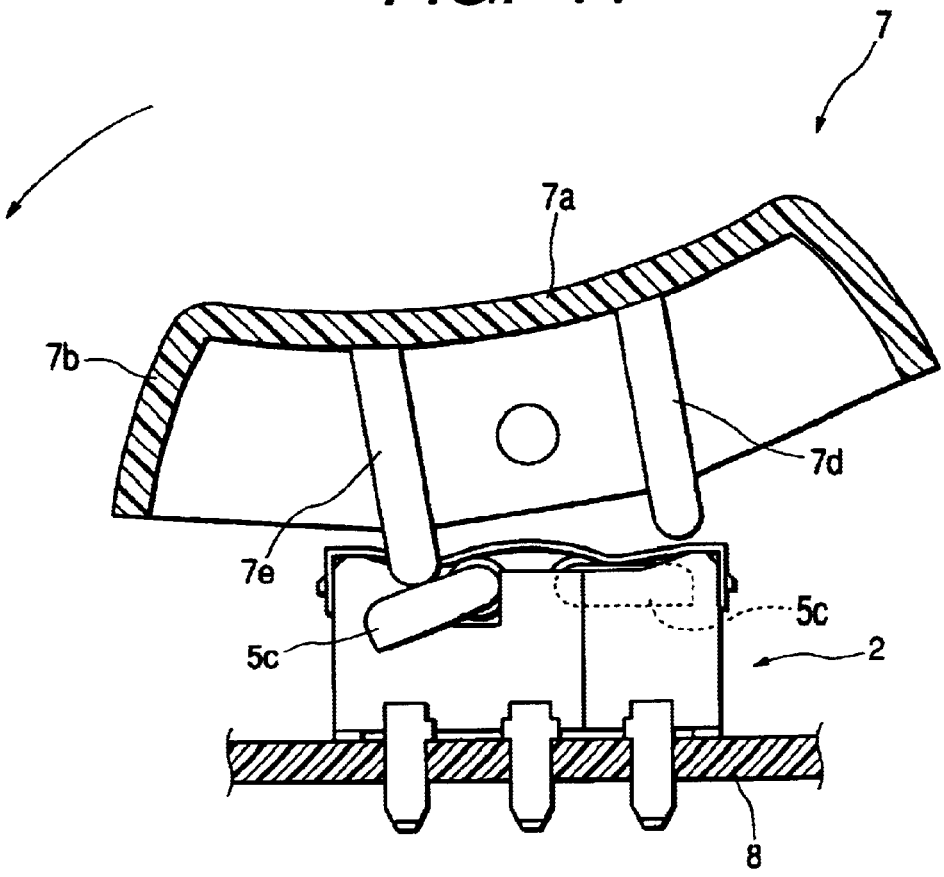
FIG. 11 is a second explanatory drawing illustrating the action of the switch device according to the invention.

Subsequently, when the other end of the upper wall portion 7*a* of the tab member 7 (left side in FIG. 7) are pressed and hence the tab member 7 is rotated (See FIG. 11) counterclockwise about the through hole 7*c* from the state shown in FIG. 7, the other operating portion 7*d* of the tab member 7 is moved away from the lever portion 5*c* of the other driving member 5 (the lever portion 5*c* on the backside in FIG. 11), whereby the switch element on the backside in FIG. 11 is maintained in the first switched state.

Since the action from this state on is almost the same as the series of action of one of the driving members 5, one of the movable contact members 4, and one of the fixed contact members 3 taken when the tab member 7 is rotated counterclockwise, it will not be described here.

In this state, when the switch device is a power window switch, for example, the motor is switched to the direction to close the window glass.

Figure 12:
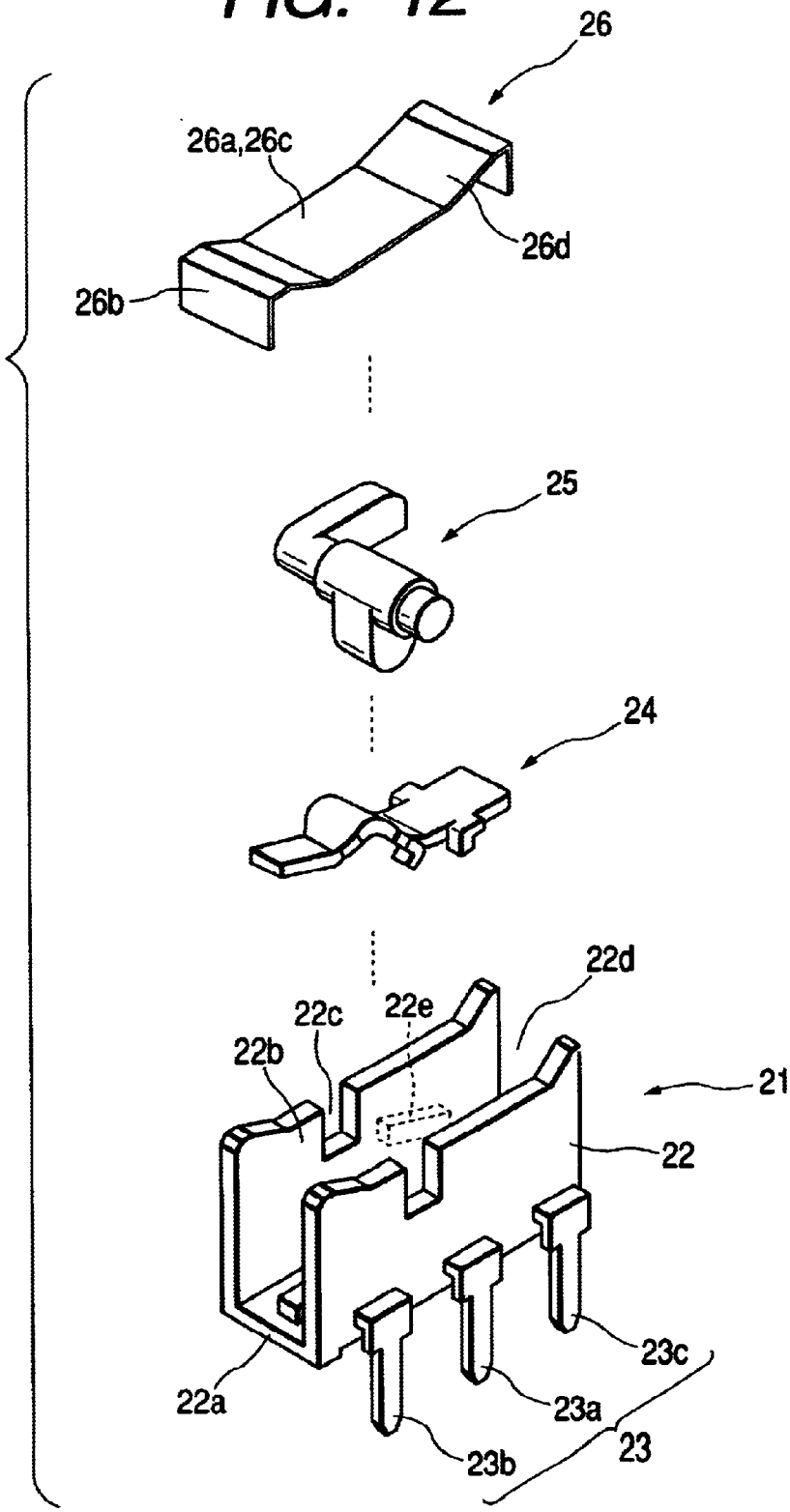
FIG. 12 is an exploded perspective view showing a second embodiment of the switch device according to the invention.

Subsequently, referring to FIG. 12, the second embodiment of the switch device according to the invention will be described.

The switch device is a so-called monopolar/double-throw switch having only a set of switch element.

An enclosure 21 is formed of insulative synthetic resin material, includes a substantially box-shaped case 22 formed by molding, and a set of fixed contact member 23 formed in the case 22 by insert molding of metallic material so as to extend partly outward from the case 22.

The case 22 includes a rectangular bottom wall 22*a,* a pair of opposing sidewalls 22*b* extending forward from the bottom wall 22*n,* a pair of open-top recesses 22*c* formed at the upper ends of the pair of sidewalls 22*b* respectively, an opened space 22*d* defined on the upper side of the pair of sidewalls 22*b,* and a stopper 22*e* provided in the vicinity of one of the recesses 22*c* on the outer side surface of one of the sidewalls 22*b*.

The pair of recesses 22*c* are disposed in such a manner that the axial line at the center thereof are coaxially aligned.

The difference in the constructions between the case 22 and the case 2 in the first embodiment described above includes the fact that the case 22 is a monopolar/double-throw switch device having only one switch element set and has one of the sidewalls 22*b* and the opened space 22*d,* while the case 2 in the first embodiment is a bipolar/double-throw switch device having two switch element sets, the first and the second sidewalls 2*b* and 2*c* surrounding four sides, and two openings 2*e* and 2*f.*

Since the fixed contact member 23 has the same construction and layout as the fixed contact member 3 described in conjunction with the first embodiment described above, detailed description will not be made. The fixed contact member 23 is constructed only of one set, and includes a set of the first, the second, and the third terminals 23*a,* 23*b* and 23*c* as a part of the construction.

Since a movable contact member 24 and the driving member 25 have the same construction and layout as the movable contact member 4 and the driving member 5 described in conjunction with the first embodiment described above, as in the case of the fixed contact member 23, detailed description will not be made.

A spring member 26 as restoring means is formed by press molding of a resilient metallic plate material, and includes a spring portion 26*a,* a pair of sidewalls 26*b* extending. substantially vertically downward from one of the opposing ends of the spring portion 26*a,* and two through holes (not shown) disposed on each sidewalls.

The spring member 26*a* includes a plate-shaped holding portion 26*c,* and a pair of tilted portion 26*d* tilting from the holding portion 26*c.*

The spring member 26 is disposed so that the spring portion 26*a* covers the opened space 22*d* formed on the case 22, and respective through holes (not shown) formed on the spring member 26 engage the opposing end surfaces of the respective sidewalls 22*b* by suitable means such as snap engagement and the like so that attachment of the spring member 26 to the case 22 is ensured.

As regards description of a method of assembly and of the action of the switch device according to the second embodiment, such method of assembly and the action are almost the same as the method of assembly and the action of the switch device according to the first embodiment described above, and thus detailed description will not be made.

The difference of the action of the switch device according to the second embodiment from the action of the switch device according to the first embodiment is that the tab member 7 (See FIG. 7) on the switch device according to the first embodiment is adapted to be capable of swinging in the clockwise and the counterclockwise directions in order to activate the alternately disposed two switch element sets by the action of the switch device, while the tab member 7 on the switch device according to the second embodiment is disposed so as to be capable of swinging only in one of the clockwise and the counterclockwise directions in order to activate one switch element set.

Figure 13:
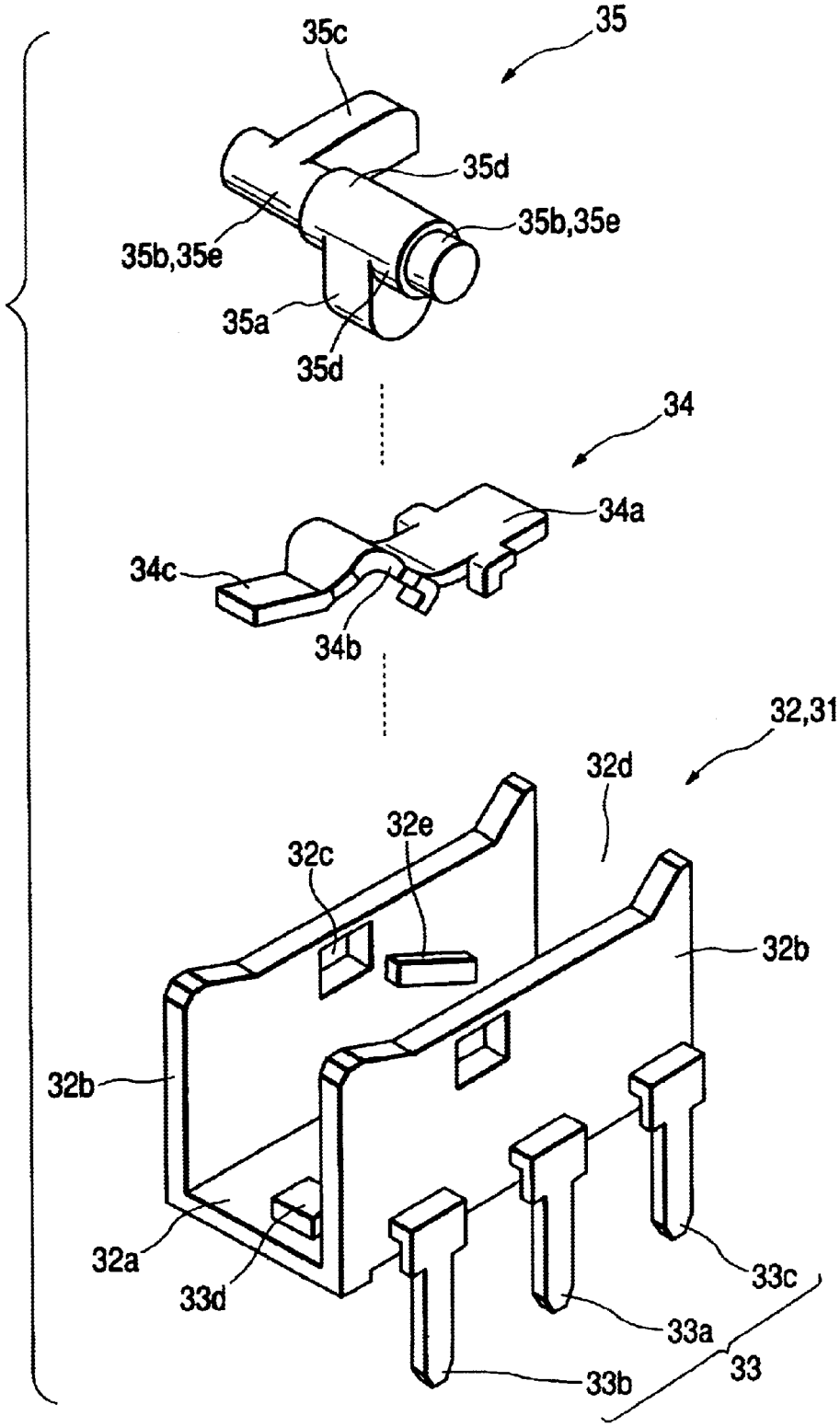
FIG. 13 is an exploded perspective view showing a third embodiment of the switch device according to the invention.

Referring now to FIG. 13, the third embodiment of the switch device according to the invention will be described. The switch device is a so-called monopolar/double-throw switch device having only one switch element set.

As shown in FIG. 13, an enclosure 31 is formed of insulative synthetic resin material, and includes a substantially box-shaped case 32 formed by molding, and a set of fixed contact member 33 formed by insert molding in the case 32 of metallic material so as to extend partly outward from the case 32.

The case 32 includes a rectangular bottom wall 32*a,* a pair of opposing sidewalls 32*b* extending vertically forward from one of the opposing outer peripheral ends of the bottom wall 32*a,* a pair of through holes 32*c* formed on the pair of sidewalls 32*b* at prescribed coaxial positions respectively, an opened space 32*d* provided upwardly thereof, and a stopper 32*e* formed on the inner side surface of one of the sidewalls 32*b* in the vicinity of one of the through holes 32*c.*

A pair of through holes 32*c* of the sidewall 32*b* of the case 32 constitutes the so-called recess described above.

Since the fixed contact member 33 has the same construction and layout as the fixed contact member 3 of the switch device according to the first embodiment described above, detailed description will not be made.

A fixed contact member 33 is constructed only of a set, and includes a set of a first, a second and a third terminals 33*a,* 33*b* and 33*c* as a part of the construction.

Since a movable contact member 34 has almost the same construction as the movable contact member 4 of the switch device according to the first embodiment described above, detailed description will not be made.

The difference between the movable contact member 34 and the movable contact member 4 described above is that the movable contact member 34 is formed by pressing of resilient conductive metal, while the movable contact member 4 described above is formed of a hard conductive metal.

The movable contact member 34 includes a flat portion 34*a,* a rising portion 34*b* and a contact portion 34*c.*

Since the movable contact member 34 having resiliency is formed of a resilient conductive metal, the contact portion 34*c* is formed so as to be deformed and moved to be bent from the rising portion 34*b* by its resiliency.

In other words, the movable contact member 34 having a resiliency constitutes restoring means for restoring the driving member 35 to its original position.

The movable contact member 34 is disposed in the case by suitable means so as to be capable of a seesaw movement about the first fixed contact point (not shown) in the case 32.

In this case, the contact portion 34*c* of the movable contact member 34 is disposed opposingly to the second contact point 33*d,* and the flat portion 34*a* is disposed opposingly to the third fixed contact point (not shown).

Since the driving member 35 is formed in almost the same construction as the driving member 5 of the switch device according to the first embodiment described above, detailed description will not be made.

Here, the difference in construction of the driving member 35 from the driving member 5 of the first embodiment will be described.

The driving member 35 includes an actuating portion 35*a,* a pair of projections 35*b,* and a lever portion 35*c,* and each of the respective projections 35*b* includes a larger diameter portion 35*d* and the smaller diameter portion 35*e.*

The length of one of the smaller diameter portions 35*e* of the projections 35*b* is longer than the length of the other smaller diameter portion 35*e,* and the lever portion 35*c* extends from the substantially center of one of the smaller diameter portions 35*e* in the direction orthogonal to the axial center of the projection 35*b.*

The driving member 35 is disposed in such a manner that the respective distal ends of the respective smaller diameter portions 35*e* of the pair of projections 35*b* are inserted into the pair of through holes 32*c* on the case 32, whereby the actuating portion 35*a* can rotate.

In this state, the distal end of the operating portion 35*a* is in abutment with the surface in the vicinity of the connecting portion between the flat portion 34*a* and the rising portion 34*b*.

The lever portion 35*c* of the driving member 35 is disposed in the vicinity of the one of the pair of the sidewalls 32*b* of the case 32.

As is described above, the switch device according to the third embodiment includes three members of; the enclosure 31 having the case 32 and a set of fixed contact member 33, a single piece of the movable contact member 34 and a single piece of the driving member 35. In other words, a switch element set is constructed of a set of fixed contact member 33, a single piece of the movable contact member 34, and a single piece of the driving member 35.

Subsequently, a method of assembling the switch device according to the third embodiment will be described.

The enclosure 31 having the case 32 and the fixed contact member 33 is placed on a predetermined assembling and transporting jib (not shown) with the opened space 32*d* faced upward.

Subsequently, the movable contact member 34 is inserted and disposed from the opened space 32*d* of the case 32 on the respective fixed contact member 33 in a predetermined orientation.

Then, a predetermined assembling jig (not shown) for widening the initial width of the opened space 32*d* of the case 32 to a predetermined width is disposed on the opened space 32*d,* and the width of the opened space 32*d* is widened to a predetermined width, by this assembling jib.

Subsequently, in a state in which the width of the opened space 32*d* is widened, the respective smaller diameter portions 35*e* of the pair of projections 35*b* are inserted and disposed into the respective through holes 32*c* on the sidewalls 32*b* of the case 32 with the free end of the actuating portion 35*a* of the driving member 35 faced downward.

Then, the assembling jib for widening the width of the opened space 32*d* into the predetermined width is removed to restore the width of the opened space 32*d* to the original width.

By restoring the width of the opened space 32*d* to the original width, the respective smaller diameter portions 35*e* of the pair of projections 35*b* are reliably inserted and disposed into the respective through holes 32*c*.

In this state, the lever portion 35*c* of the driving member 35 is disposed in parallel with the surface of the bottom wall 32*a* and disposed in the vicinity of the stopper 32*e* of the case 32.

The free end of the actuating portion 35*a* of the driving member 35 abuts against and is disposed on the movable contact member 34.

The action of the switch device according to the third embodiment will be described.

Before operating the switch device, the lever portion 35*c* of the driving member 35 is in parallel with the bottom wall 32*a,* and as in the case of the switch device according to the first embodiment described above, the driving member 35 is placed at the neutral position. The switch element is in the first switched state in which the movable contact member 34 is in contact with the first fixed contact point 33*a* and the third fixed contact point 33*c* so that the portion between the first and the third fixed contact points 33*a* and 33*c* is in the ON (contact) state, and the first and the second fixed contact points 33*a* and 33*b* are moved away from each other so that the portion between the first fixed contact point 33*a* and the second fixed contact point 33*b* is in the OFF (non-contact) state.

Subsequently, when the lever portion 35*c* of the driving member 35 is rotated in the clockwise direction by suitable means from this state, the rotation of the lever portion 35*c* allows the actuating portion 35*a* to slide (to be displaced) from the flat portion 34*a* of the movable contact member 34 over the rising portion 34*b* to rotate the movable contact point 34 about the first fixed contact point 33*a,* and the resilient rising portion 34*b* to be displaced resiliently. Consequently, the second switched state in which the contact portion 34*c* of the movable contact member 34 and the second fixed contact point 33*b* are brought into contact with each other to the ON state, and the first fixed contact point 33*a* and the second fixed contact point 33*b* are moved away from each other to the OFF (non-contact) state is achieved.

In this state, since the pair of projections 35*b* of the driving member 35 are inserted into the pair of through holes 32*c* constituting the so-called recess, the driving member 35 is adapted to rotate about the axial centers of the pair of projections 35*b*.

Then, when the rotational movement effected by pressing the lever portion 35*c* is released, the pressure from the actuating portion 35*a* of the driving member 35 is displaced from the rising portion 34*b* to the flat portion 34*a* by a self-restoring force of the resilient movable contact member 34 so that the original position is restored, and the restoration of the original position returns the movable contact member 34 to the first switched state.

Figure 14:
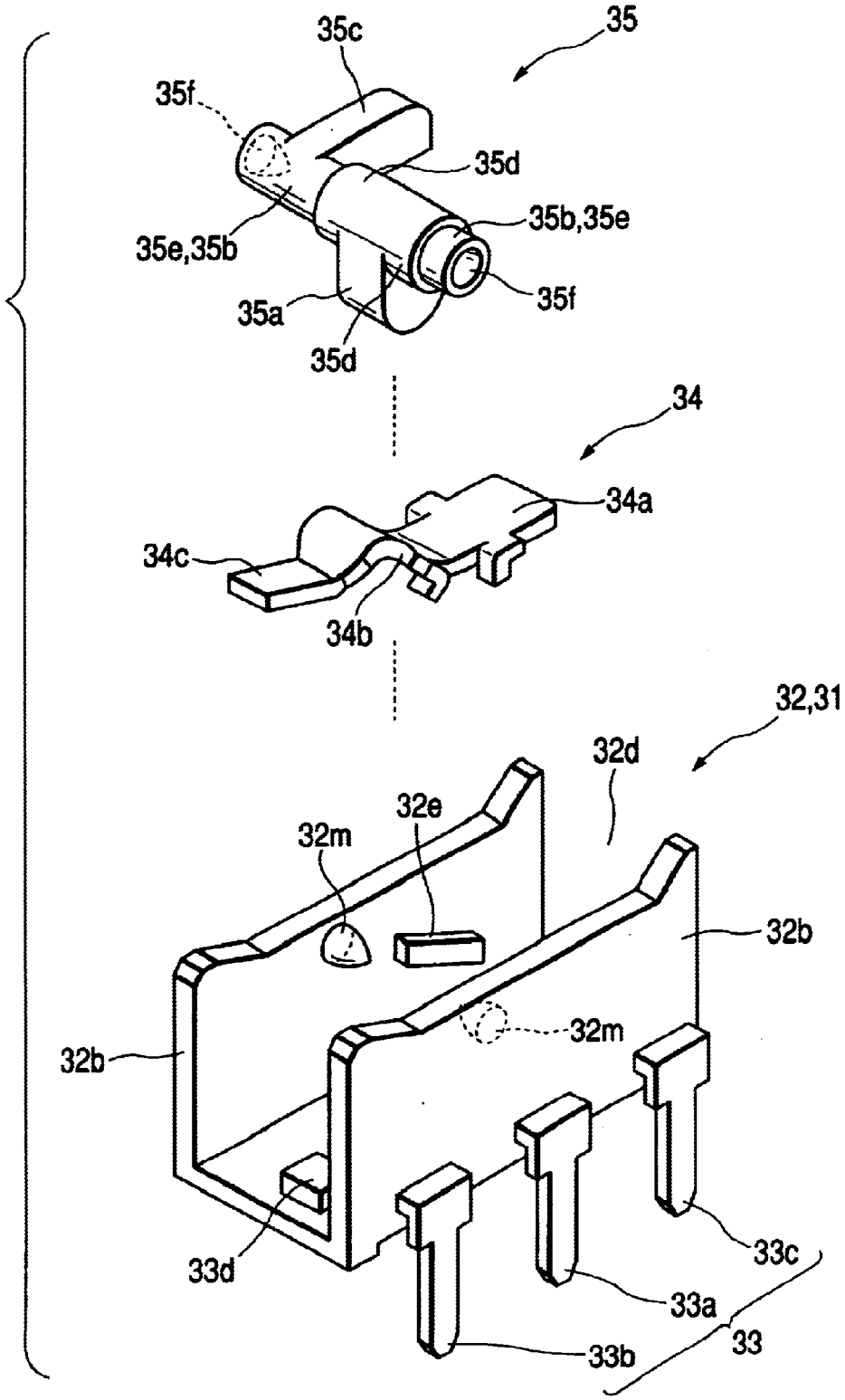
FIG. 14 is an exploded perspective view showing a fourth embodiment of the witch device according to the invention.

Referring to FIG. 14, the fourth embodiment of the switch device according to the invention will be described. The switch device is a so-called monopolar/double-throw switch device having only one switch element set.

As shown in FIG. 14, the basic construction of the switch device in the fourth embodiment is almost the same construction as the switch device of the third embodiment described above, the same construction being represented by the same reference numerals and a detailed description will not be made.

Accordingly, the switch device according to the fourth embodiment will be described only in terms of the difference from the switch device according to the third embodiment.

The difference is as follows. In the case of the switch device according to the third embodiment described above, the pair of through holes 32*c* constituting the recesses are formed on the sidewalls 32*b* of the case 32 and the pair of projections 35*b* are formed on the driving member 35. In addition, the pair of projections 35*b* of the driving member 35 are disposed in the pair of through holes 32*c* of the case 32.

On the other hand, in the case of the switch device according to the fourth embodiment, as shown in FIG. 14, a pair of projections 32*m* is formed on the opposing inner surfaces of the sidewalls 32*b* of the case 32, and a pair of recesses 35*f* are formed at the distal ends of the respective smaller diameter portions 35*e* of the pair of projections 35*b* of the driving member 35 coaxially with the respective smaller diameter portions 35. The pair of projections 32*m* of the case 32 are disposed in the pair of recesses 35*f* of the driving member 35.

The switch device according to the third embodiment and the switch device according to the fourth embodiment differ from each other in that the recess and the projection are disposed in the different ways.

Since the method of assembly and the action of the switch device according to the fourth embodiment is almost the same as the switch device according to the third embodiment described above, the description will not be made.

Subsequently, referring to FIG. 15, the fifth embodiment of the switch device according to the invention will be described.

This switch device will be described as a monopolar/single-throw switch device having a switch element set.

Figure 15:
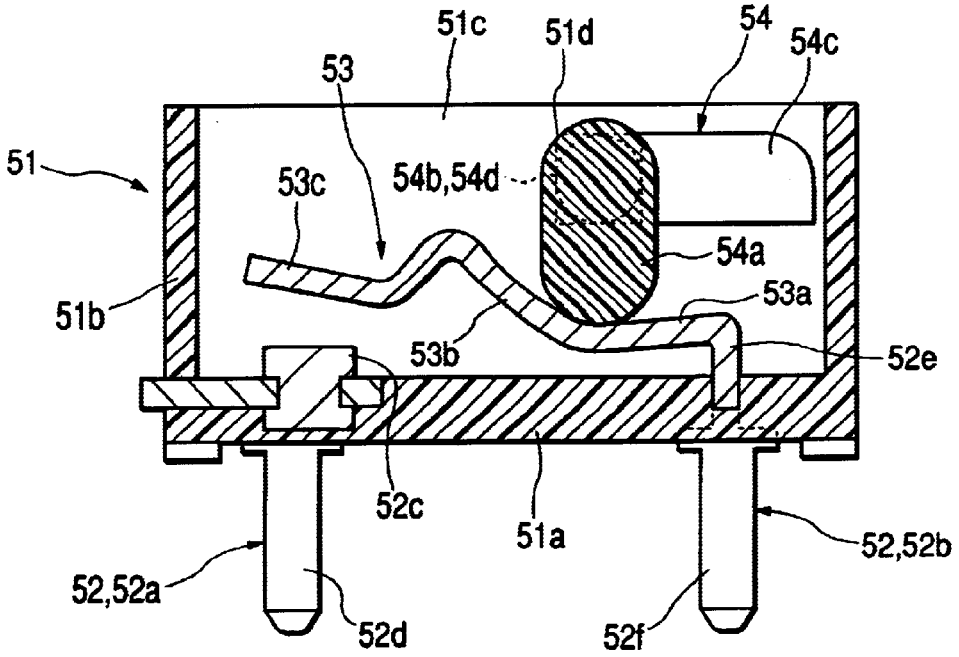
FIG. 15 is a cross sectional view showing a fifth embodiment of the switch device according to the invention.

As shown in FIG. 15, a case 51 includes a rectangular bottom wall 51*a*, a sidewall 51*b* extending from the bottom wall 51*a* and surrounding four sides, an opening 51*c* formed on top of the sidewall 51*b*, and a pair of holes 51*d* provided coaxially on one of the opposing sidewalls 51*b*.

A fixed contact member 52 includes a first fixed contact point 52*a*, and a second fixed contact point 52*b* disposed away from the first fixed contact point 52*a* by a predetermined distance.

The first fixed contact point 52*a* includes a first contact portion 52*c* and a first terminal 52*d* extending from the first contact portion 52*c*.

The second fixed contact point 52*b* includes a second contact portion 52*e* and a second terminal 52*f* extending from the second contact portion 52*e*.

The fixed contact member 52 constructed of the first fixed contact point 52*a* and the second fixed contact point 52*b* is insert molded on the bottom wall 51*a* of the case 51, and the first contact portion 52*c* and the second contact portion 52*e* are disposed so as to be exposed from the inner wall surface of the bottom wall 51*a*.

The movable contact member 53 is formed of a resilient plate material of conductive metal, and includes a flat portion 53*a* formed on one of the end side, and a rising portion 53*b* extending from one of the ends of the flat portion 53*a* in a tilted manner, and a contact portion 53*c* extending from one of the ends of the rising portion 53*b*.

In other words, the movable contact member 53 is formed into an asymmetric shape.

One of the ends of the flat portion 53*a* is continuing from the second contact portion 52*e* of the second fixed contact point 52*b*, whereby the movable contact member 53 is integrated with the second fixed contact point 52*b*. In this case, the movable contact member 53 is disposed in the sidewall 51*b* surrounding four sides opposingly to the bottom wall 51*a*, and the contact portion 53*c* is disposed at the position away from (non-contact) the first contact portion 52*c* of the first fixed contact point 52*a*.

Since the resilient movable contact member 53 is formed of a resilient conductive metal, for example, the contact portion 53*c* is formed so as to be deformed and moved to be bent from the rising portion 53*b* by its resiliency.

In other words, the movable contact member 53 having a resiliency constitutes restoring means for restoring a driving member 54 to its original position.

The driving member 54 has almost the same construction as the driving member 34 of the switch device according to the third embodiment described above, and includes an actuating portion 54*a*, a pair of projections 54*b* and a lever portion 54*c*, and each of the respective projections 54*b* includes a larger diameter portion (not shown) and a smaller diameter portion 54*d*.

The length of the smaller diameter portion 54*d* of one of the projections 54*b* is longer than the length of the other smaller diameter portion (not shown), and the lever portion 54*c* extends from the substantially center of one of the smaller diameter portions 54*d* in the direction orthogonal to the axial center of the projection 54*b*.

As shown in FIG. 15, the switch device according to the fifth embodiment is constructed of two members; one of the members is constructed of the case 51, the fixed contact member 52 and the movable contact member 53, the other one of the members being constructed of the driving member 54.

Subsequently, the action of the switch device according to the fifth embodiment will be described.

Since the switch device is constructed of the second fixed contact point 52*b* of the fixed contact member 52 and the flat portion 53*a* of the movable contact member 53 integrally continuing with each other as described above, the second fixed contact point 52*b* and the movable contact member 53 are constantly conducted (ON: contact) irrespective of whether or not the driving member 54 is in operation.

The action of the lever portion 54*c* of the driving member 54 when not in operation will be described here. The actuating portion 54*a* of the driving member 54 is disposed perpendicularly with respect to the bottom wall 51*a*, and the free end of the actuating portion 54*a* is in abutment with the flat portion 53*a* of the movable contact member 53. In this case, the contact portion 53*c* of the movable contact member 53 is away from the first fixed contact point 52*a* of the fixed contact member 52, and thus the switch element is in the OFF (non-contact) state.

The action of the lever portion 54*c* of the driving element 54 when in operation will be described now. When the lever portion 54*c* rotates in the clockwise by the operation of a tab member (not shown) disposed above the switch device, the free end of the actuating portion 54*a* moves along the tilted surface from the flat portion 53*a* to the rising portion 53*b* being tilted.

By the movement of the actuating portion 54*a*, the resilient rising portion 53*b* rotates counterclockwise about the flat portion 53*a* (pressed downward), and the rotation (pressed downward) of the rising portion 53*b* allows the contact portion 53*c* to be brought into contact with the first fixed contact point 52*a* (first contact portion 52*c*) of the fixed contact member 52, whereby the switch element is brought into the ON (contact) state.

When the operation of the tab member (not shown) is released, the actuating portion 54*a* is displaced from the rising portion 53*b* and restored to the original position by a resilient force (restoring force) of the movable contact member 53, and the contact portion 53*c* is moved away from the first fixed contact point 52*a*, whereby the switch element is brought into the original OFF (non-contact) state. When the actuating portion 54*a* is restored to its original position, the lever potion 54*c* rotates counterclockwise.

Figure 16:
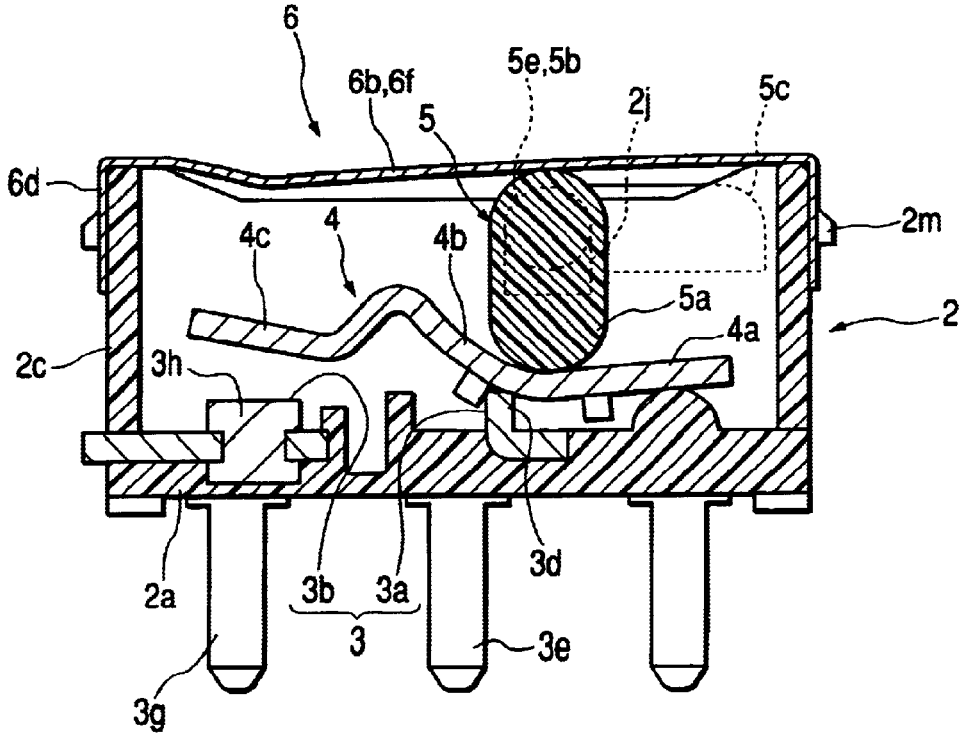
FIG. 16 is a first cross sectional view showing a sixth embodiment of the switch device according to the invention.
Figure 17:
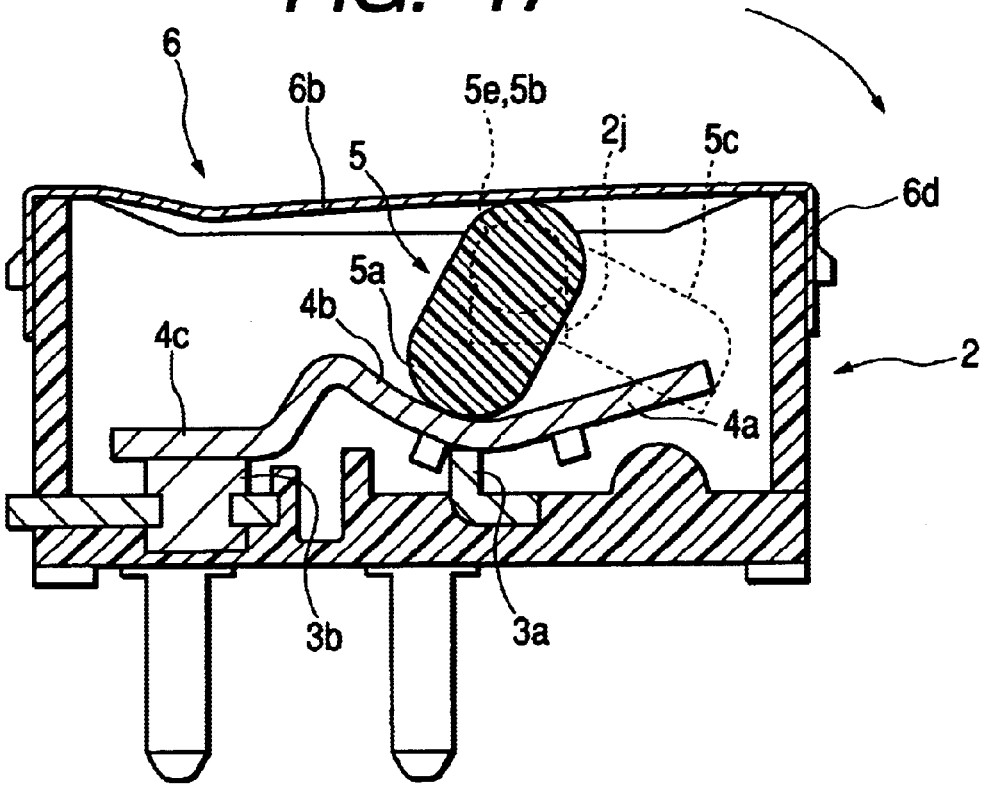
FIG. 17 is a second cross sectional view of the sixth embodiment of the switch device according to the invention.
Figure 18:
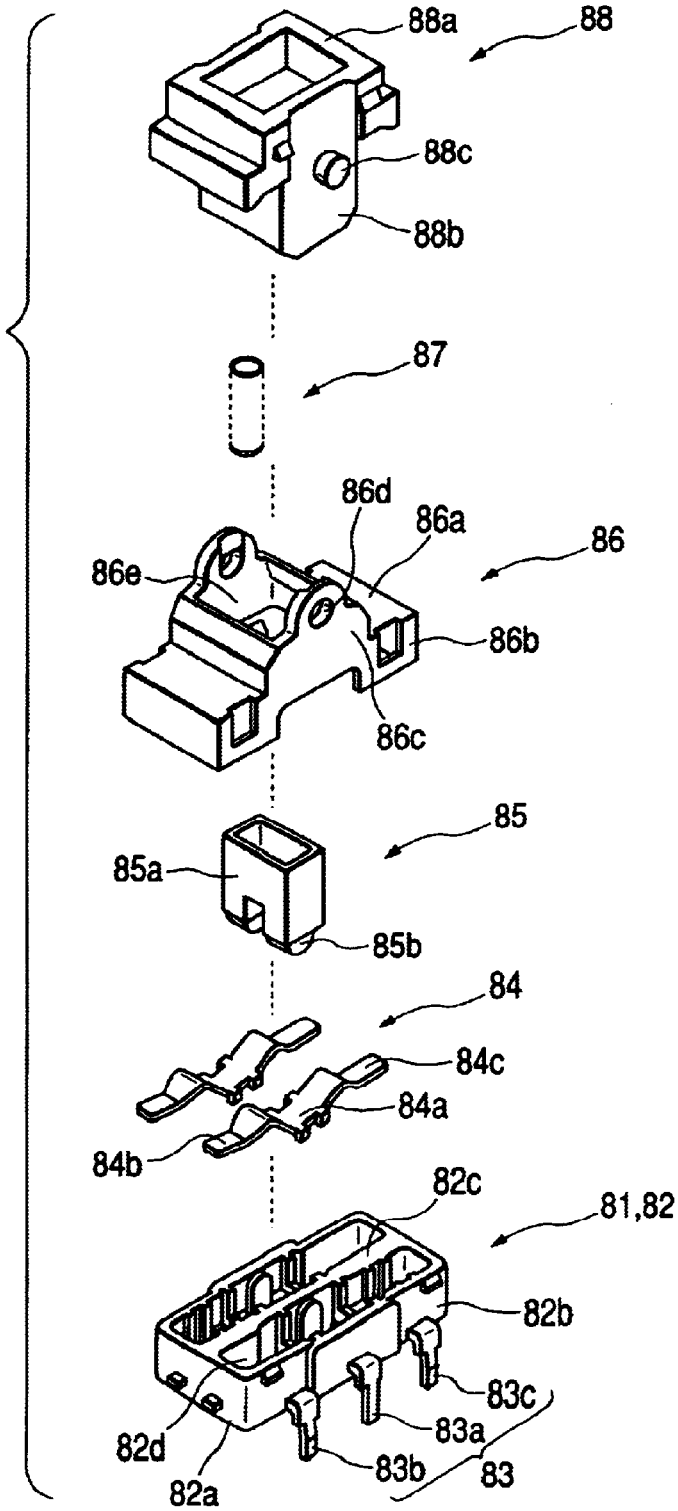
FIG. 18 PRIOR ART
FIG. 18 is an exploded perspective view showing the switch device in the related art.
Figure 19:
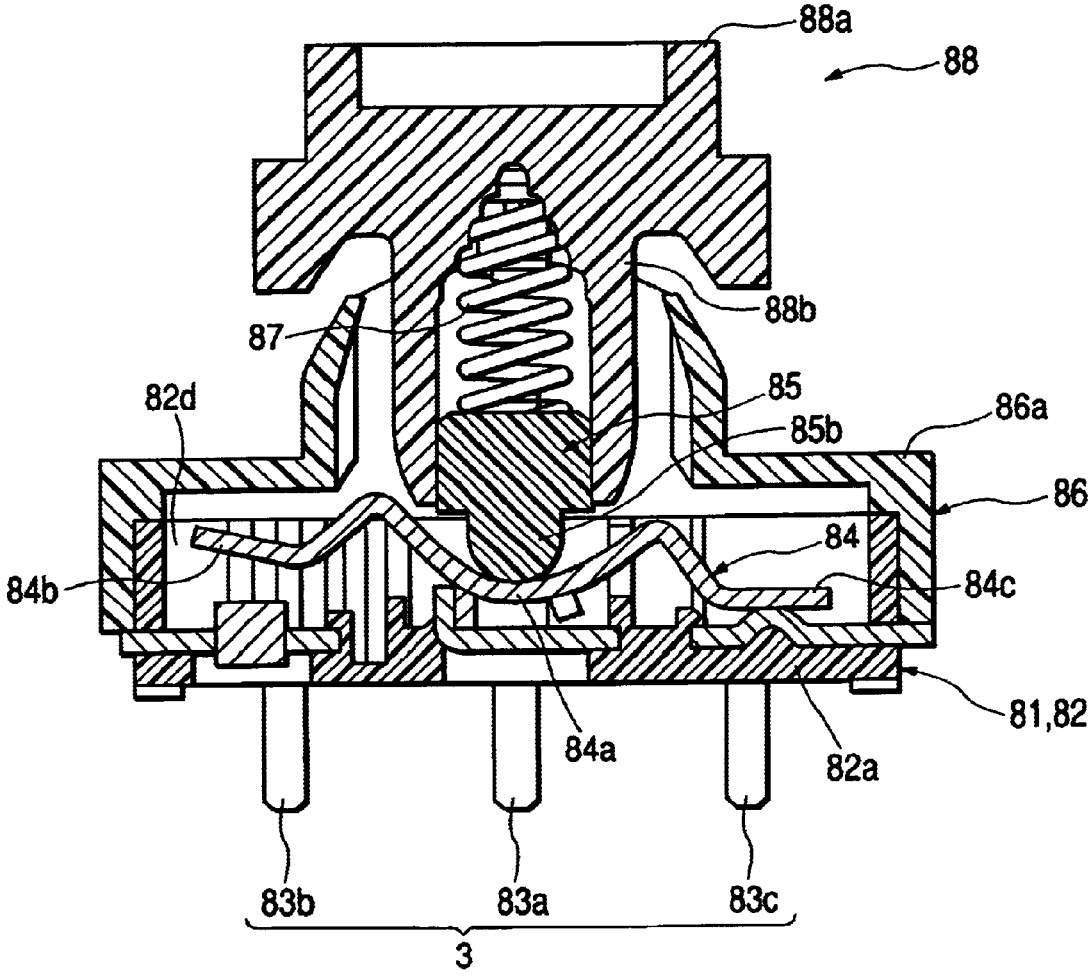
FIG. 19 PRIOR ART
FIG. 19 is a cross sectional view showing the switch device in the related art.

Referring now to FIG. 16 and FIG. 17, the sixth embodiment of the switch device according to the invention will be described.

This switch device is described as a monopolar/single-throw switch device having a switch element set. In this switch device, the same components as the switch device according to the first embodiment described above will be represented by the same reference numerals and will not be described here.

Here, the difference in construction between the switch device according to the first embodiment described above and the switch device according to the sixth embodiment will be described.

The difference is such that in the switch device according to the first embodiment the fixed contact member 3 includes the first, the second and the third fixed contact points 3*a*, 3*b* and 3*c,* and the first, the second and the third terminals 3*e,* 3*g* and 3*j* of the first, the second and the third fixed contact point 3*a,* 3*b* and 3*c* respectively, while in the switch device according to the sixth embodiment the fixed contact member 3 includes only the first and the second fixed contact points 3*a* and 3*b,* and the first and the second terminals 3*e* and 3*g* respectively of the first and the second fixed contact point 3*a* and 3*b.*

In other words, the switch device according to the sixth embodiment is not provided with the third fixed contact point 3*c.*

In this arrangement, the monopolar/single-throw switch device is constructed.

Although the switch device is described as a monopolar/single-throw switch device here, it is applicable as a matter of course to dispose two of these switch devices in parallel to form a bipolar/single-throw switch device.

The action of the switch device according to the sixth embodiment is almost the same as the action of the bipolar/double-throw switch device in the first embodiment described above, and the difference is only that the switch device according to the sixth embodiment is a single-throw switch device as described above. Therefore, description will not be made here.

Although the restoring means in the embodiments described above is formed by a plate-shaped resilient spring member, it is not limited thereto, and the restoring means may be formed of a resilient member such as rubber, wire spring, or the like.

As described thus far, the switch device according to the invention includes: a case having a bottom wall and at least an opposing pair of sidewalls extending from the bottom wall; a fixed contact member provided on the bottom wall of the case; a movable contact member disposed in the case; a driving member rotatably mounted on the pair of sidewalls; restoring means for restoring the driving member to the original position; and the driving member including an actuating portion for moving the movable contact member and an operating portion for rotating the actuating member, and is constructed in such a manner that the actuating portion is rotated when the operating portion of the driving member is driven and hence the actuating portion moves the movable contact member so that the movable contact member is brought into contact with a fixed contact member, and the driving member is restored to the original position in which the movable contact member and the fixed contact member are brought out of contact by restoring means when the driven state of the operating portion is released. Accordingly, since the number of components is small, they can be assembled by stacking the components in sequence from above, and thus a switch device that is easy to assemble and has a small size can be provided.

Since the switch device according to the invention is constructed in such a manner that the driving member is driven by the spring member toward the bottom wall, and the driving member is restored to the original state by driving force of the spring member, the layout and the operation of the driving member and the spring member are simple, and thus a switch device which is simple in construction and cost-effective can be provided.

Since the switch device according to the invention is constructed in such a manner that the driving member moves away from the bottom wall against a driving force of the spring member when the actuating portion of the driving member driven by the spring member toward the bottom wall rotates, and simultaneously, the driving elements rotate so that the actuating portion moves the movable contact member to bring the movable contact member and the fixed contact member into contact with each other, while the driving member is restored to the original state by the spring member to bring the movable contact member out of contact with the fixed contact member when the rotation of the driving member is released, the action of the spring member is simple, whereby a switch device in which the driving member can be operated smoothly and has a stable performance may be provided.

Since the switch device of the invention is constructed in such a manner that the operating portion of the driving member is positioned outside the case and the stopper is disposed outside the case, so that the operating portion abuts against the stopper to limit the rotational movement thereof, the operating portion is positioned outside the case, whereby a switch device in which the operation of the operating portion can be facilitated and its construction simplified is provided.

Since the switch device according to the invention is constructed in such a manner that the driving member is formed with a projection, and the case is formed with a recess, and the projection is disposed into the recess so that the driving member is rotatably mounted to the case, it is easier to form the projection on the driving member and the recess on the case, whereby a cost-effective switch device that can easily be assembled is provided.

Since the switch device according to the invention is constructed in such a manner that the recess on the sidewall is formed to have almost the same width as the diameter of the recess on the driving member, and the projection is adapted to be movable in the vertical direction in the recess, the projection of the driving member is movable in the vertical direction in the recess, whereby a switch device in which the projection is not subject to an excessive force and a stable performance can be maintained for a long time is provided.

The switch member according to the invention is constructed in such a manner that the movable contact member performs a seesaw movement by the pressure of the actuating portion being displaced from the flat portion to the rising portion so that the movable contact member is brought into contact with the fixed contact member, and performs a seesaw movement to be restored to the original state by the pressure of the actuating portion being displaced from the rising portion to the flat portion so that the movable contact member is brought out of contact with the fixed contact member, the seesaw movement of the movable contact member may be performed by a simple action of the actuating portion of the driving member, whereby a switch device that ensures reliable action is provided.

The switch device of the invention is constructed in such manner that the fixed contact member includes the third fixed contact point, and the movable contact member is brought into contact with the first fixed contact point and the third fixed contact point and thus the portion between the first and the third fixed contact points is in the ON state when the driving member is not in operation, while the flat portion of the movable contact member is brought out of contact with the third fixed contact point and thus the portion between the first and the third fixed contact points is in the OFF state, and simultaneously the movable contact member is bought into contact with the second fixed contact point so that the portion between the first and the second fixed contact points is in the ON state when the driving member is actuated, whereby a cost-effective monopolar/double-throw switch device having a small number of components is provided.

The switch device according to the invention is constructed in such a manner that a switch element set is constructed of the fixed contact member, the movable contact member, the driving member, and the restoring means and two switching element sets are disposed in parallel in the case, whereby a cost-effective bipolar/double-throw switch device that includes a small number of components and is easy to assemble is provided.

The switch device according to the invention is constructed in such a manner that the two movable contact members constituting a part of two sets of switching elements are disposed alternately with respect to the case so that the flat portions of the respective movable contact members are oriented in the opposite directions. Accordingly, since the asymmetric two movable contact members are disposed alternately with respect to the case, the longitudinal dimension of the case may be shortened, whereby a downsizable switch device is provided.

What is claimed is:

1. A switch device comprising:

a case having a bottom wall and at least an opposing pair of sidewalls extending from the bottom wall;

a fixed contact member provided on the bottom wall of the case;

a movable contact member disposed in said case;

a driving member rotatably mounted on said pair of sidewalls; and a restoring unit that restores said driving member to an original state, and said driving member including an actuating portion that moves said movable contact member and an operating portion that rotates the actuating portion, wherein said actuating portion is rotated when said operating portion of said driving member is driven and hence said actuating portion moves said movable contact member so that said movable contact member is brought into contact with said fixed contact member, and said driving member is restored to the original state in which said movable contact member and said fixed contact member are brought out of contact by said restoring unit when a driven state of said operating portion is released.

2. The switch device according to claim 1, wherein said restoring unit is constructed of a spring member.

3. The switch device according to claim 2, wherein said driving member is driven by said spring member toward said bottom wall, and said driving member is restored to the original state by a driving force of said spring member.

4. The switch device according to claim 3, wherein said spring member comprises a plate having spring characteristics.

5. The switch device according to claim 4, wherein said case includes said sidewalls surrounding four sides and an opening formed on top thereof, and wherein the opening is covered by said spring member formed of said plate.

6. A switch device according to claim 3, wherein said spring member is snap engaged with said sidewalls of said case.

7. A switch device according to claim 3, wherein said driving member moves away from said bottom wall against a driving force of said spring member when said actuating portion of said driving member rotates, and simultaneously, said driving member rotates so that said actuating portion moves said movable contact member to bring said movable contact member and said fixed contact member into contact with each other, while said driving member is restored to the original state by said spring member to bring said movable contact member out of contact with said fixed contact member when the rotation of said driving member is released.

8. A switch device according to claim 1, wherein said case is provided with a stopper for limiting a rotatable range of said operating portion of said driving member.

9. A switch device according to claim 8, wherein said operating portion of said driving member is positioned outside said case and said stopper is disposed outside said case, so that said operating portion abuts against said stopper to limit a rotational movement thereof.

10. A switch device according to claim 1, further comprising a projection on one of said driving member and one of said opposing sidewalls of said case, and a recess on the other one of them and said projection in said recess, wherein said driving member is rotatably mounted on said case.

11. A switch device according to claim 10, wherein said driving member is formed with said projection, said case is formed with said recess, and said projection is disposed into said recess so that said driving member is rotatably mounted to said case.

12. A switch device according to claim 11, wherein the upper end of said sidewalls includes said recess opened on top, and said projection is fitted into said recess from above.

13. A switch device according to claim 12, wherein said recess on said sidewalls is formed to have almost a same width as a diameter of said projection on said driving member, and said projection moves in a vertical direction in said recess.

14. A switch device according to claim 1, wherein said movable contact member includes a flat portion, a rising portion extending from one end of the flat portion in a tilted state, and a contact portion extending from one end of the rising portion and coming into and out of contact with said fixed contact member, and said movable contact member is supported so as to be capable of a seesaw movement.

15. A switch member according to claim 14, wherein said movable contact member performs a seesaw movement due to a pressure of said actuating portion being displaced from said flat portion to said rising portion so that said movable contact member is brought into contact with said fixed contact member, and performs a seesaw movement to be restored to the original state by the pressure of said actuating portion being displaced from said rising portion to said flat portion so that said movable contact member is brought out of contact with said fixed contact member.

16. A switch member according to claim 14, wherein said fixed contact member is constantly in contact with said movable contact point, and includes a first fixed contact point for supporting said movable contact member, and a second fixed contact point for coming into and out of contact with said movable contact member, and wherein said movable contact member performs a seesaw movement about said first fixed contact point.

17. A switch device according to claim 16, wherein said fixed contact member includes a third fixed contact point, and said movable contact member is brought into contact with said first fixed contact point and said third fixed contact point and thus a portion between said first and said third fixed contact points is in an ON state when said driving member is not in operation, while said flat portion of said movable contact member is brought out of contact with said third fixed contact point and thus the portion between said first and said third fixed contact points is in an OFF state, and simultaneously said movable contact member is bought into contact with said second fixed contact point so that a portion between said first and said second fixed contact points is in the ON state when said driving member is actuated.

18. A switch device according to claim 1, further comprising a switch element set constructed of said fixed contact member, said movable contact member, said driving member, and said restoring unit, and two switching element sets are disposed in parallel in the case.

19. A switch device according to claim 18, wherein said two movable contact members constituting a part of said two switching element sets are disposed alternately with respect to said case so that said flat portions of said respective movable contact members are oriented in opposite directions.

20. A switching device according to claim 18, further comprising said spring member formed of a plate, wherein said spring member includes a slit and a first and a second spring portions located on either sides of the slit, wherein the first and the second spring portions are disposed so as to cover an upper portion of said case, and wherein a first driving member constituting a part of said two switching elements is pressurized by said first spring portion and a second driving member is pressurized by said second spring portion.

* * * * *